US006628799B2

(12) United States Patent
Fukuda

(10) Patent No.: US 6,628,799 B2
(45) **Date of Patent: *Sep. 30, 2003**

(54) LOUDSPEAKER SYSTEM

(76) Inventor: Sakuji Fukuda, Ribieru Takahata 2-A 101, 1507-2, Misawa, Hino-shi, Tokyo (JP), 191-0032

( * ) Notice: Subject to any disclaimer, the term of this patent is extended or adjusted under 35 U.S.C. 154(b) by 0 days.

This patent is subject to a terminal disclaimer.

(21) Appl. No.: 10/152,785

(22) Filed: May 23, 2002

(65) Prior Publication Data

US 2002/0136423 A1 Sep. 26, 2002

Related U.S. Application Data

(62) Division of application No. 09/554,141, filed as application No. PCT/JP98/05199 on Nov. 19, 1998, now Pat. No. 6,504,939.

(30) Foreign Application Priority Data

Nov. 19, 1997 (JP) ..... 9-335004
Jul. 7, 1998 (JP) ..... 10-207166

(51) Int. Cl.[7] ..... H04R 25/00

(52) U.S. Cl. ..... 381/398; 381/386; 381/345; 381/349

(58) Field of Search ..... 381/345, 349, 381/386, 391, 189, 398, 337, 347, 350, 397; 181/199, 171, 155, 156

(56) References Cited

U.S. PATENT DOCUMENTS 6,504,939 B1 * 1/2003 Fukuda ..... 381/386

FOREIGN PATENT DOCUMENTS

JP 408251683 * 9/1996

* cited by examiner

*Primary Examiner*—Huyen Le
(74) *Attorney, Agent, or Firm*—James Creighton Wray; Meera P. Narasimhan

(57) ABSTRACT

The outer peripheral site of a loudspeaker unit is provided with predetermined air passages formed along substantially the overall inner perimeter of an opening in a baffle plate for allowing a communication between the interior and the exterior of an enclosure, whereby there is provided a loudspeaker system capable of achieving, e.g., improvements in low-frequency characteristics and in transient characteristics while implementing reductions in size and weight.

A loudspeaker unit is mounted on the baffle plate in such a manner that between the rear face of the outer peripheral portion of the loudspeaker unit and the front face of the baffle plate there are formed gaps acting as predetermined air passages which extend along substantially overall inner perimeter of the opening in the baffle plate and which allow a communication between the interior and exterior of the enclosure, with an annular rim being provided for regulating the areas confronting both the rear face or the front face of the outer peripheral portion of the loudspeaker unit and the front face or the rear face of the baffle plate, whereby a loudspeaker system is provided which is capable of achieving, e.g., an enhancement in low-frequency characteristics, and an improvement in the quality of sounds over the full frequency range.

5 Claims, 22 Drawing Sheets

(A)

(B)

LOUDSPEAKER SYSTEM

This application is a division of application Ser. No. 09/554,141 filed May 10, 2000, now U.S. Pat. No. 6,504, 439, which is a 371 of PCT/JP98/05199 filed Nov. 11, 1998, which claims the benefit of Japanese Application No. 9-335004 filed Nov. 19, 1997 and Japanese Application No. 10-207166 filed Jul. 7, 1998.

BACKGROUND OF THE INVENTION

1. Field of the Invention

The present invention relates generally to a loudspeaker system, and more particularly to a technique directed at improving the quality of sounds.

2. Brief Description of the Prior Art

In the conventional loudspeaker systems, importance is commonly attached to the enclosure sealing properties.

The reason is that any sound pressure leakage from the enclosure may adversely affect the frequency characteristics.

More specifically, sound waves leaking from the enclosure may interfere with direct sounds from the loudspeaker system and disturb the frequency characteristics. In particular, sound waves leaking from the site apart farther from the loudspeaker system may often have the same sound pressure phases within the interior of the enclosure, resulting in an acute interference.

It is therefore an inviolable rule in typical mounting of the loudspeaker unit on the enclosure baffle to keep the sealing at the mounting surfaces. This mounting is carried out in a textbook manner.

As can be seen in FIGS. 25(A) and 25(B) for example, a loudspeaker unit 1 is mounted such that the internal face of a flange portion 2 at its peripheral portion comes into intimate contact with the front face of a baffle plate 4 of an enclosure 3. Alternatively, the loudspeaker unit 1 is mounted such that the external face of the flange portion 2 comes into intimate contact with the rear face of the baffle plate 4.

In general, the bass characteristics of the loudspeaker system are restricted by the lowest resonance frequency of the loudspeaker unit and the requirement for reproduction of the unit lowest resonance frequency is to impart a sufficient capacity to the unit mounted enclosure. In the conventional loudspeaker systems attaching importance to the enclosure sealing properties, however, the action on the diaphragm of inertial vibrations of the air spring within the enclosure may adversely affect the low-frequency characteristics and transient characteristics of the loudspeaker system. In particular, if the mounting capacity is smaller than the enclosure capacity required by the loudspeaker unit, then the low-frequency characteristics may suffer a remarkable damping.

A loudspeaker unit having a large-diameter diaphragm is suitable for the bass reproduction although use of the large-diameter diaphragm may lead to an increase of the enclosure capacity, rendering an enlargement in dimensions of the loudspeaker system inevitable.

For this reason, the typical loudspeaker system intended for the bass reproduction is apt to add to its size and weight, resulting in high costs and low handling properties.

With a view to solving such deficiencies and reducing the system size, there have been proposed a system using bass reflex, a resonance chamber or an acoustic tube for loading, a seal-up system having sound absorption materials filled into the interior thereof, and a system making corrections based on output detection such as motional feedback and including an electronic circuit such as an equalizer. All of them have however caused any complications in structure, resulting inevitably in a rise of fabrication costs. In such cases, the systems had tendencies of the quality of sounds proper thereto.

Hitherto known as the loudspeaker system cabinet (enclosure) is an R-J cabinet of a type in which as illustrated in FIG. 26 a loudspeaker unit 5 fitted to a supplementary baffle plate 6 is mounted on a baffle plate 8 at the front of a cabinet (enclosure) 7 in a spaced apart manner.

In this R-J cabinet, however, air passages allowing a communication between the interior and exterior of the cabinet 7 open to opposed side ends of an opening 9 of the baffle plate 8, with the result that in spite of its improved bass characteristics the output sound pressure levels in the mid-frequency band will lower with its characteristics having peaks in the vicinity of the bass reproduction limit frequency.

In the past, there has also been proposed a configuration in which a partition is positioned behind the diaphragm spaced by a predetermined distance apart from the diaphragm so as to define an acoustic space therebetween, the inner periphery of the acoustic space leading into the space within the loudspeaker box, the outer periphery of the acoustic space opening to the front face of the loudspeaker box by way of an air vent ring (see Japanese Patent Laid-open Pub. No. Hei2-195796).

This configuration allows the space defined between the partition and the diaphragm to act as a duct for effectively guiding the bass reproduction outputs of the loudspeaker and to enhance the basses since the space at its inner periphery leads into the space within the loudspeaker box and at its outer periphery opens to the front face of the loudspeaker box.

It is however difficult to readily apply this technique to the existing loudspeaker system because the loudspeaker unit itself needs to have an unique specification due to its configuration in which the partition and the air vent ring are integrally mounted on the diaphragm, i.e., the cone to make up the loudspeaker system thereby forming the above space portion.

At the same time, the structure of the cone is also complicated with its increased weight, disadvantageously adding to costs.

Furthermore, due to its bent configuration of the space portion, a smooth radiation of air within the enclosure is not achieved, rendering it difficult to effectively prevent any influence on the diaphragm of the inertial vibrations of the air spring within the interior of the enclosure.

SUMMARY OF THE INVENTION

The present invention was conceived in order to solve the conventional problems as set forth hereinabove. It is therefore the object of the present invention to provide a simple improved attachment structure to the baffle plate of the enclosure of the loudspeaker unit to thereby achieve a reduction in size and weight of the loudspeaker system and achieve an enhancement in the low-frequency characteristics and transient characteristics.

In addition to the above object, it is another object to ensure an easy and secure adjustment of the gaps formed along substantially the overall inner perimeter of the opening in the baffle plate between the rear face of the outer peripheral portion of the loudspeaker unit and the front face of the baffle plate, to thereby achieve an enhancement in the bass characteristics and an improvement in the quality of sounds for instance.

The loudspeaker system according to a first aspect of the present invention can satisfy items (1) to (4) which follow.

(1) To enhance the low-frequency band through radiation of resonant sounds within the interior of the enclosure.

(2) To improve the transient characteristics over the full reproduction range to acquire a free, easy and gloomless quality of sounds through the reduction of influences on the diaphragm of inertial vibrations of air springs within the interior of the enclosure.

(3) To achieve more effectively an improvement in the quality of sound through effective reduction of resistance to which the coned paper is subjected as a result of a variation in the air pressure within the interior of the enclosure.

(4) To enhance the bass frequency characteristics and simultaneously prevent any turbulence of characteristics at the other frequencies.

To this end, according to the first aspect of the present invention, there is provided a loudspeaker system including an enclosure and a loudspeaker unit adapted to be fitted to an opening in a baffle plate at the front of the enclosure, wherein around the outer peripheral site of the loudspeaker unit there are formed predetermined air passages which extend along substantially the overall inner perimeter of the opening in the baffle plate, for allowing a communication between the interior and exterior of the enclosure.

It has been found out that in the woofer unit or full-range unit, the optimal value can be conferred on the spatial volume provided equi-angularly between the periphery of the woofer unit frame and the baffle face by use of the spacers at the positions of the unit mounting screws, whereby the optimal spatial volume can serve as a regulator to control the air pressure within the enclosure. Furthermore, the quality of sounds from the sound generator has been improved by fixing the vibration body to the baffle face at several points in place of the surfaces.

The predetermined air passages allowing a communication between the interior and exterior of the enclosure serve as sound holes which through the bass reflex action radiate resonant sounds within the interior of the enclosure to reinforce the bass frequencies.

Influences on the diaphragm of inertial vibrations of the air spring lying within the enclosure are reduced and transient characteristics over the full reproduction range are improved, with the result that a free, easy and gloomless sound quality is obtained.

Furthermore, since the air passages are formed along the outer peripheral site of the loudspeaker unit so as to extend along substantially the overall inner perimeter of the opening in the baffle plate, air can flow in and out uniformly through the outer peripheral site of the loudspeaker unit and the coned paper of the loudspeaker unit can have a gentle curvature toward the air passages, with the result that resistance to which the coned paper may be subjected as a result of a variation in the air pressure within the interior of the enclosure is effectively reduced, achieving an effective improvement in the quality of sounds.

In particular, since the air passages are formed in close vicinity to the loudspeaker unit and along substantially the overall inner perimeter of the opening in the baffle plate, it is possible to enhance the bass frequency characteristics as well as to prevent any turbulences of characteristics at the other frequencies.

In such a case, the loudspeaker unit may be mounted on the baffle plate in such a manner that gaps are defined as the air passages between the rear face of the outer peripheral portion of the loudspeaker unit and the front face of the baffle plate.

Alternatively, the loudspeaker unit may be mounted on the baffle plate in such a manner that gaps are defined as the air passages between the front face of the outer peripheral portion of the loudspeaker unit and the rear face of the baffle plate.

In this case, by way of a plurality of spacers, the gaps may be formed between the internal face of the outer peripheral portion of the loudspeaker unit and the front face of the baffle plate or between the external face of the outer peripheral portion of the loudspeaker unit and the rear face of the baffle plate.

The plurality of spacers may each be in the form of a substantially tubular member, with fittings inserted through the interior of the tubular member being securely fastened to the outer peripheral portion of the loudspeaker unit and to the baffle plate.

In this event, preferably the plurality of spacers are each formed of a material having a predetermined vibration absorptivity.

The plurality of spacers may be formed integrally with the loudspeaker unit or with the baffle plate.

In case of the configuration where the loudspeaker unit is mounted on the baffle plate in such a manner that the gaps are formed as the air passages between the rear face of the peripheral portion of the loudspeaker unit and the front face of the baffle plate, the enclosure may have a top wall portion and a bottom wall portion which are extended forwardly, the enclosure having a pair of right and left support members situated in front of the baffle plate for coupling to the extended portions, with the outer peripheral portion of the loudspeaker unit being fitted to the support members so as to space the outer peripheral portion of the loudspeaker unit apart from the baffle plate, to thereby form the gaps.

Furthermore, the loudspeaker unit may have an attachment protrusion formed integrally with its outer peripheral portion, the attachment protrusion having a plurality of openings which provide the air passages, the attachment protrusion being fitted to the external face or internal face of the baffle plate.

Also, the baffle plate may have an attachment protrusion projecting from the inner peripheral face of the opening, the loudspeaker unit having an attachment protrusion which projects from its outer peripheral face, two the attachment protrusions being coupled together so as to form gaps acting as the air passages between the inner peripheral face of the opening and the outer peripheral portion of the loudspeaker unit.

Incidentally, the enclosure may have a bass reflex port or a bass radiation hole for bass reflex.

In case of the provision of such a bass reflex port by the bass reflex duct or the provision of the bass radiation hole for bass reflex, the peripheral sound pressure can be raised by employing as low a resonance frequency as possible of the bass reflex port or the bass radiation hole.

The loudspeaker system according to a second aspect of the present invention can satisfy items (1) to (4) which follow.

(1) To achieve a reduction in size and weight of the enclosure while simultaneously ensuring an enhanced low-frequency band, a low distortion and a high efficiency.

(2) To provide a loudspeaker system having improved transient characteristics and economic considerations.

(3) To restrain a reduction of the additional mass on the loudspeaker unit diaphragm which may arise from air within the interior of the enclosure, to thereby suppress the damping in the bass reproduction characteristics.

(4) To secure effectiveness in any small-sized loudspeaker systems which are liable to undergo a reduction in the addition mass on the loudspeaker unit diaphragm and which are apt to suffer any damping in the bass reproduction characteristics.

To this end, according to the second aspect of the present invention, there is provided a loudspeaker system including an enclosure and a loudspeaker unit adapted to be fitted to an opening in a baffle plate at the front of the enclosure, wherein the loudspeaker unit is mounted on the baffle plate in such a manner that between the rear face of the outer peripheral portion of the loudspeaker unit and the front face of the baffle plate there are formed gaps acting as predetermined air passages which extend along substantially the overall inner perimeter of the opening in the baffle plate and which allow a communication between the interior and exterior of the enclosure, and wherein said loudspeaker unit has on its outer peripheral portion rear face an annular rim for adjusting confronting areas of the rear face of said outer peripheral portion and of the front face of said baffle plate.

Alternatively, there is also provided a loudspeaker system including an enclosure and a loudspeaker unit adapted to be fitted to an opening in a baffle plate at the front of the enclosure, wherein the loudspeaker unit is mounted on the baffle plate in such a manner that between the front face of the outer peripheral portion of the loudspeaker unit and the rear face of the baffle plate there are formed gaps acting as predetermined air passages which extend along substantially the overall inner perimeter of the opening in the baffle plate and which allow a communication between the interior and exterior of the enclosure, and wherein the loudspeaker unit has on its outer peripheral portion front face an annular rim for adjusting confronting areas of the front face of the outer peripheral portion and of the rear face of the baffle plate.

It has been found out that in the woofer unit or full-range unit, the optimal value can be conferred on the spatial volume provided equi-angularly between the periphery of the woofer unit frame and the baffle face by use of the spacers at the positions of the unit mounting screws, whereby the optimal spatial volume can serve as a regulator to control the air pressure within the enclosure. Furthermore, the quality of sounds from the sound generator has been improved by fixing the vibration body to the baffle face at several points in place of the surfaces.

The predetermined air passages allowing a communication between the interior and exterior of the enclosure serve as sound holes which through the bass reflex action radiate resonant sounds within the interior of the enclosure to reinforce the bass frequencies.

Influences on the diaphragm of inertial vibrations of the air spring lying within the enclosure are reduced and transient characteristics over the full reproduction range are improved, with the result that a free, easy and gloomless sound quality is obtained.

Furthermore, since the air passages are formed along the outer peripheral site of the loudspeaker unit so as to extend along substantially the overall inner perimeter of the opening in the baffle plate, air can flow in and out uniformly through the outer peripheral site of the loudspeaker unit and the coned paper of the loudspeaker unit can have a gentle curvature toward the air passages, with the result that resistance to which the coned paper may be subjected as a result of a variation in the air pressure within the interior of the enclosure is effectively reduced, achieving an effective improvement in the quality of sounds.

Also, since the air passages are formed in close vicinity to the loudspeaker unit and along substantially the overall inner perimeter of the opening in the baffle plate, it is possible to enhance the bass frequency characteristics as well as to prevent any turbulences of characteristics at the other frequencies.

Then, for a bass loudspeaker including a flame rib which acts as the fitting surface to the baffle plate but has no even annular shape or including a small fitting surface area wherein it may be difficult to regulate the gaps formed along substantially the overall inner perimeter of the baffle plate opening between the rear face of the outer peripheral portion of the loudspeaker unit and the front face of the baffle plate, a large-diameter annular rim is mounted on the front face or rear face of the outer peripheral portion of the loudspeaker unit so as to increase the confronting areas of the rear face or front face of the outer peripheral portion and of the front face or rear face of the baffle plate, whereby there can easily be achieved an enhancement in the low-frequency characteristics and an improvement in the quality of sounds over the full range.

In the mid-frequency sound loudspeaker system and the high-frequency sound loudspeaker system, for the purpose of improving the auditory localization of image sounds through the radiation of sounds within the enclosure from the periphery thereof, a large-diameter annular rim is mounted on the rear face or front face of the outer peripheral portion of the loudspeaker unit so as to increase the confronting areas of both the rear face or the front face of the outer peripheral portion of the loudspeaker unit and the front face or the rear face of the baffle plate, thereby making it possible to prevent the low-frequency characteristics from being degraded.

In such a case, in the configuration where the annular rim is provided on the rear face of the outer peripheral portion of the loudspeaker unit, the loudspeaker unit may have on its outer peripheral portion an annular rim portion located at the rear face of the outer peripheral portion, a plurality of spacer portions projecting backward from the rear face of the annular rim portion, and a ring-like rib portion positioned behind the rear face of the annular rim portion for coupling the plurality of spacers to one another, the rim portion, the plurality of spacer portions and the rib portion being integrally formed with the outer peripheral portion of the loudspeaker unit, the rib portion being fitted to the front face of the baffle plate.

In case of providing the annular rim on the external peripheral portion front face of the loudspeaker unit, the loudspeaker unit may have on its outer peripheral portion an annular rim portion located at the front face of the outer peripheral portion, a plurality of spacer portions projecting forward from the front face of the annular rim portion, and a ring-like rib portion positioned in front of the front face of the annular rim portion for coupling the plurality of spacers to one another, the rim portion, the plurality of spacer portions and the rib portion being integrally formed with the outer peripheral portion of the loudspeaker unit, the rib portion being fitted to the rear face of the baffle plate.

By virtue of the structure where the annular rim and spacers are previously formed integrally with the loudspeaker unit itself in this manner, the number of parts of the apparatus can totally be reduced. Application of the present invention to any loudspeaker systems will thus become possible by the attachment of only the loudspeaker unit, contributing to fabrication easiness.

DETAILED DESCRIPTION OF THE PREFERRED EMBODIMENTS

Embodiments of the present invention will be described here in below.

The present invention will now be described in greater detail with reference to the accompanying drawings.

Description is first made of a first aspect of the present invention.

The basic concept of the first aspect is as follows.

The problems of loudspeaker size reduction and its attendant degradation in bass frequency characteristics can be solved by isolating the diaphragm of the loudspeaker unit from any influence of damping which may be caused by the air spring lying within the enclosure.

For example, a stringed instrument such as a guitar or a contrabass can produce excellent basses or low-frequency sounds under the action of its resonance box although it merely has vibrating elements with minute surface areas in the form of strings. It can also produce extremely rich harmonics providing overtone components.

This is due to the fact that vibrations of the strings acting as the vibrating elements are transmitted via the bridges to the resonance box so as to utilize the resonance of the body as much as possible.

As is apparent from this example, the enclosure can be used as the resonance box in order to achieve most simple and effective reproduction of basses by the loudspeaker system.

Thus, according to the basic concept of the first aspect of the present invention, the outer peripheral site of the loudspeaker unit is provided with predetermined air passages extending along substantially the overall inner perimeter of the baffle plate opening, for allowing a communication between the interior and exterior of the enclosure, and the loudspeaker unit is located apart from the opening, e.g., to such an extent as to prevent an occurrence of degradation of bass frequency characteristics arising from detouring of the basses without any intimate contact with the baffle plate opening surface of the enclosure, to thereby obviate any influences on the diaphragm of the air spring lying within the enclosure to consequently achieve an effective use of the enclosure as the resonance box.

Description will then be made of embodiments of the loudspeaker system based on such a basic concept of the first aspect of the present invention.

Figure 1:
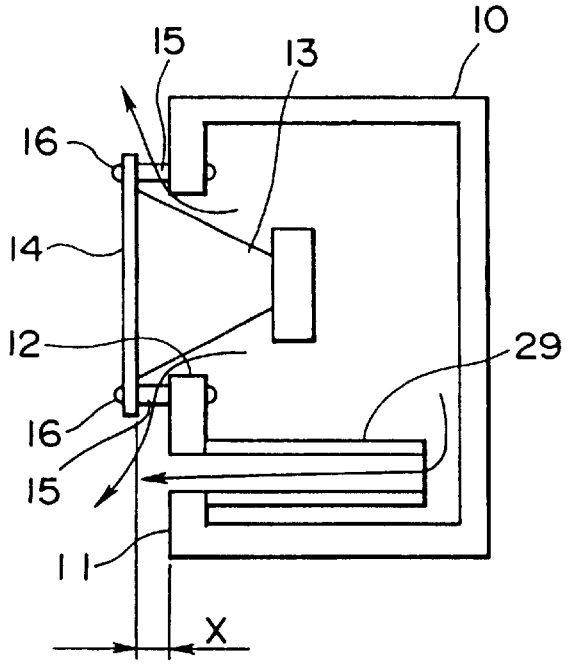
FIG. 1 is a longitudinal sectional view of a first embodiment of a loudspeaker system in accordance with a first aspect of the present invention.

FIG. 1 is a longitudinal sectional view of the loudspeaker system in accordance with a first embodiment.

In this diagram, the loudspeaker system comprises an enclosure 10 and a loudspeaker unit 13 fitted to an opening 12 in a baffle plate 11 situated at the front of the enclosure 10.

The loudspeaker unit 13 is mounted on the baffle plate 11 in such a manner that gaps are formed between the rear face of a flange 14 at the outer peripheral portion of the loudspeaker unit 13 and the front face of the baffle plate 11, the gaps providing predetermined air passages allowing a communication between the interior and the exterior of the enclosure 10.

In this embodiment, a plurality of tubular spacers 15 are interposed between the internal face of the flange 14 at the outer peripheral portion of the loudspeaker unit 13 and the front face of the baffle plate 11 so that the loudspeaker unit 13 is secured to the baffle plate 11 by means of machine screws 16 acting as fittings for insertion into the spacers 15.

Figure 3:
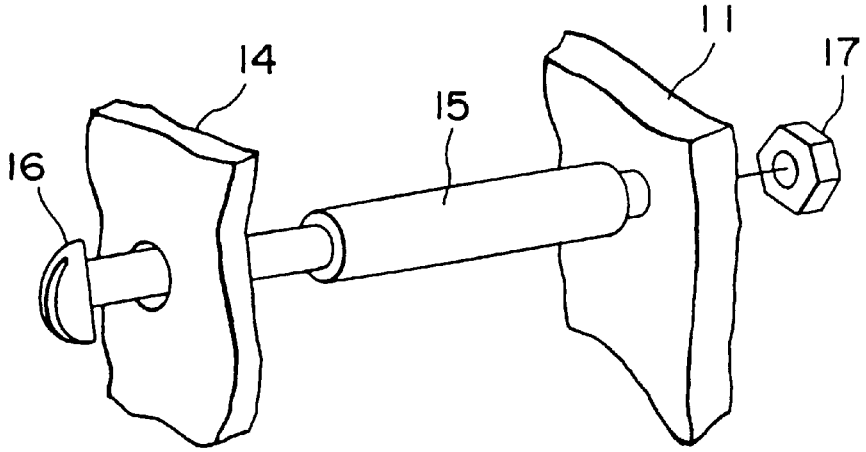
FIG. 3 is a perspective view for explaining a method of fastening a baffle plate, spacers and a loudspeaker unit together by means of machine screws.

In this case, eight screw insertion holes are formed in an equi-angularly spaced manner in both the outer periphery of the flange 14 of the loudspeaker unit 13 and the inner perimeter of the opening in the baffle plate 11, and as illustrated in FIG. 3, the machine screws 16 are inserted through the insertion holes associated with the loudspeaker unit 13, through holes of the spacers 15 and through the insertion holes associated with the baffle plate 11 in the mentioned order, after which nuts 17 are screwed and tightened onto ends, protruding from the rear face of the baffle plate 11, of threaded leading portions of the machine screws.

The spacers 15 for use herein can be made of, e.g., a rigid material such as metals (vibration transmission type), or a resilient material or member such as rubbers or coil springs (vibration absorption type).

It is preferred in case of the vibration absorption spacer 15 that between the nut 17 and the baffle plate 11 there intervene a washer made of rubber or other resilient material.

Figure 2:
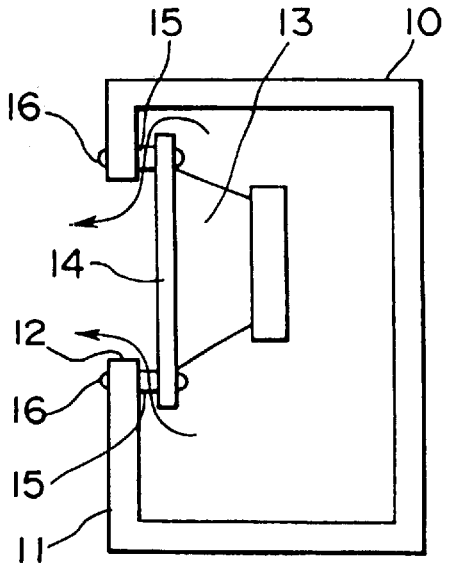
FIG. 2 is a longitudinal sectional view of a second embodiment.

FIG. 2 is a longitudinal sectional view of a loudspeaker system in accordance with a second embodiment.

In this embodiment, the loudspeaker unit 13 is mounted in such a manner that between the front face of its flange 14 and the rear face of the baffle plate 11 there are formed gaps having a predetermined distance.

In this embodiment, the plurality of spacers 15 are interposed between the front face of the loudspeaker unit 13 and the rear face of the baffle plate 11 so that the loudspeaker unit 13 is fitted to the baffle plate 11 by means of the machine screws 16 inserted through the spacers 15.

The spacers 15 may be formed integrally with the loudspeaker unit 13 or with the baffle plate 11.

Figure 4:
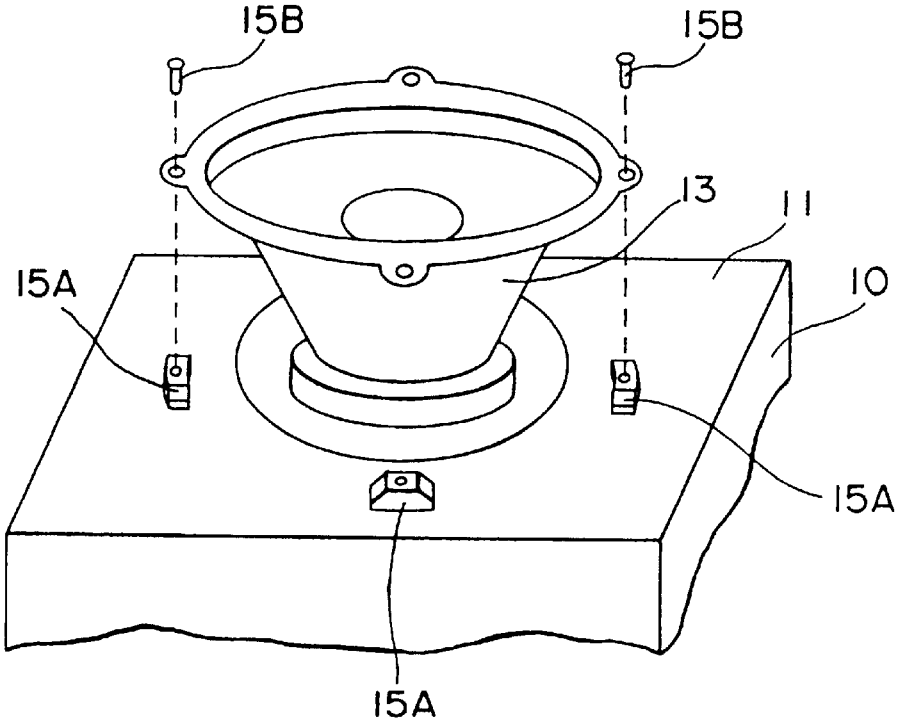
FIGS. 4(A) and 4(B) are a perspective view and a sectional view, respectively, showing a variant of the first embodiment.
Figure 4:
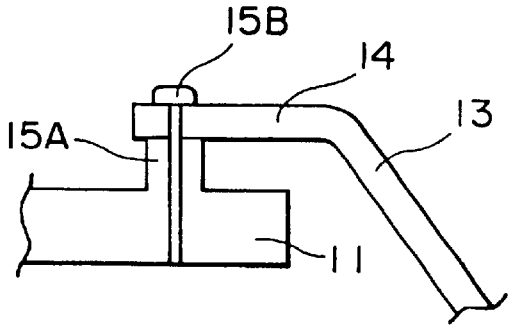

For example, as seen in FIGS. 4(A) and 4(B), the baffle plate 11 may previously have a plurality of spacer portions 15A formed integrally therewith so that the flange 14 of the loudspeaker unit 13 can be attached to the spacer portions 15A.

For this attachment, as shown in the same diagram, rivets 15B or split pins can be used. Alternatively, use may be made of pins and C-rings fitted into the pins.

Figure 5:
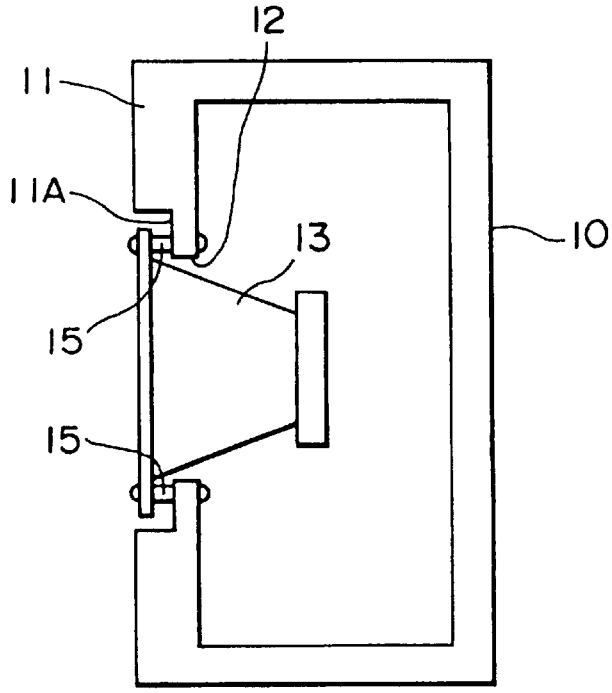
FIG. 5 is a longitudinal sectional view showing another variant of the first embodiment.

It will be appreciated that as illustrated in FIG. 5, a recessed portion 11A may be formed around the opening 12 on the external face of the baffle plate 11 so that the flange 14, the spacers 15 and the baffle plate 11 can be fastened together within the interior of the recessed portion 11A, whereby a smart shape is conferred on the loudspeaker system 10 without any protrusion of the loudspeaker unit 13 from the front face of the baffle plate 11.

Figure 6:
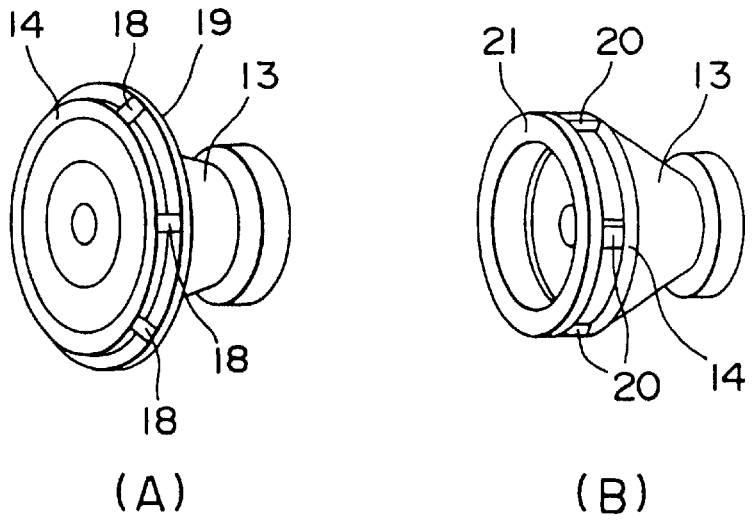
FIGS. 6(A) and 6(B) are perspective views of third and fourth embodiments, respectively.

FIGS. 6(A) and 6(B) are perspective views of a loudspeaker unit of a loudspeaker system in accordance with third and fourth embodiments, respectively.

In the embodiment of FIG. 6(A), the flange 14 of the loudspeaker unit 13 is provided integrally with a plurality of spacer portions 18 projecting backward from the rear face of the flange 14 and with a ring-like rib 19 positioned behind the rear face of the flange 14 for coupling the spacer portions 18 with one another, the rib 19 being fastened to the baffle plate front face by means of machine screws and nuts.

In the embodiment of FIG. 6(B), the flange 14 of the loudspeaker unit 13 is provided integrally with a plurality of spacer portions 20 projecting forwardly from the front face of the flange 14 and with a ring-like rib 21 positioned in front of the front face of the flange 14 for coupling the spacer portions with one another, the rib 21 being fastened to the baffle plate rear face by means of machine screws and nuts.

Figure 7:
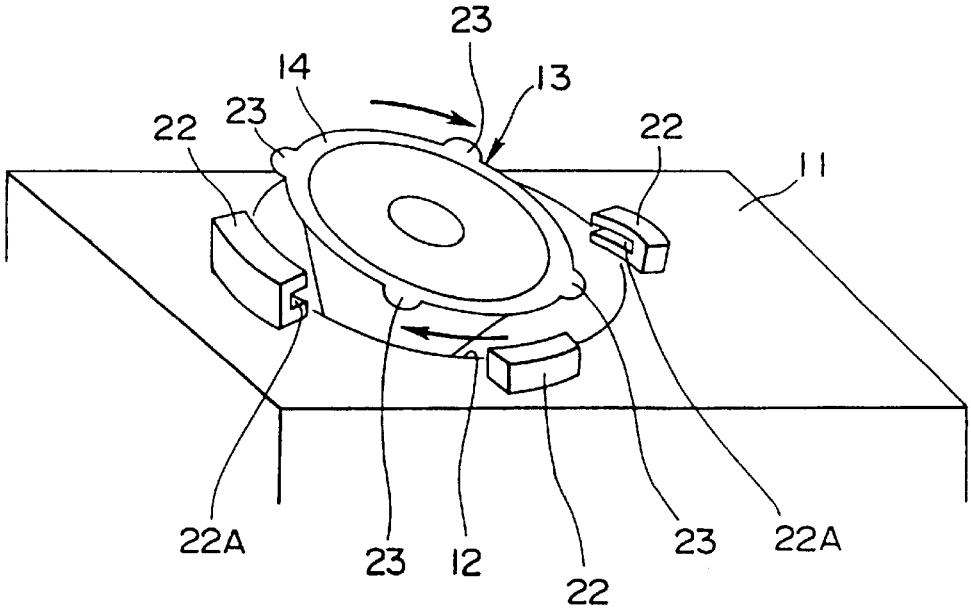
FIG. 7 is a perspective view of a fifth embodiment.

FIG. 7 is a perspective view of a loudspeaker unit of a loudspeaker system in accordance with a fifth embodiment. In this embodiment, a plurality of ribs 22 providing spacers are formed integrally around the opening 12 in the baffle plate 11, the ribs 22 each having a groove 22A formed in the inner peripheral surface thereof, whereas the flange 14 of the loudspeaker unit 13 is provided with a plurality of outwardly extending fitting protrusions 23, whereby the fitting protrusions 23 can be fitted into the grooves 22A of the ribs 22 by turning the loudspeaker unit 13.

Figure 8:
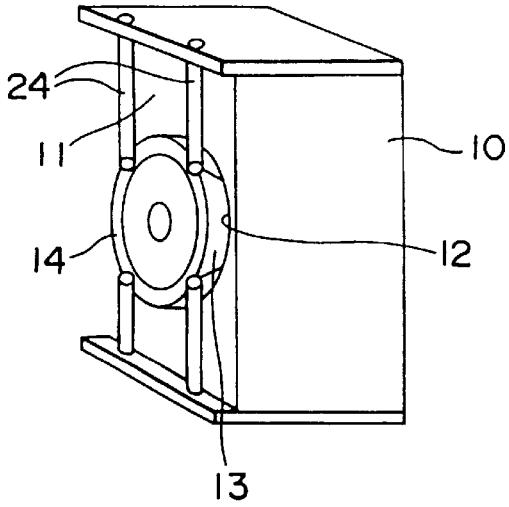
FIG. 8 is a perspective view of a sixth embodiment.

FIG. 8 is a perspective view of a loudspeaker unit of a loudspeaker system in accordance with a sixth embodiment. In this embodiment, the enclosure 10 has forwardly extending top and bottom walls to which a pair of right and left support members 24 are coupled via their respective upper and lower ends, the support members 24 being situated at the front of the baffle plate 11 so that the flange 14 of the loudspeaker unit 13 is fitted to the pair of support members 24, whereby the flange 14 of the loudspeaker unit 13 is spaced apart from the baffle plate 11 to form gaps providing air passages between the flange 14 of the loudspeaker unit 13 and the opening 12.

Figure 9:
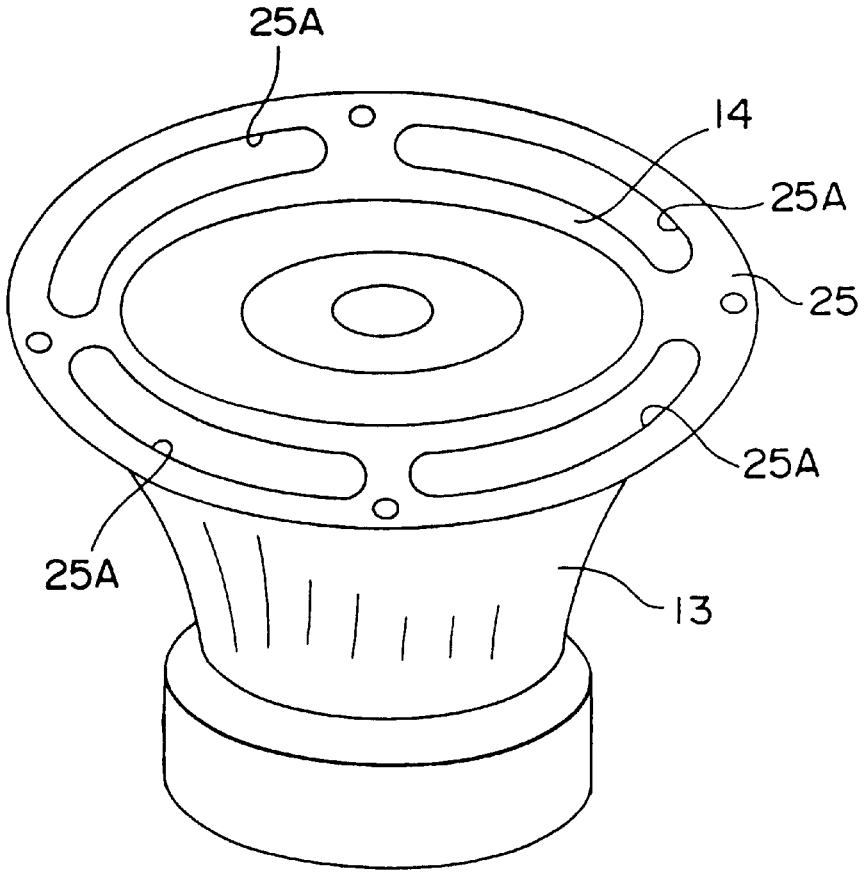
FIG. 9 is a perspective view of a seventh embodiment.

FIG. 9 is a perspective view of a loudspeaker unit of a loudspeaker system in accordance with a seventh embodiment.

In this embodiment, the flange 14 of the loudspeaker unit 13 is provided integrally with a fitting plate 25 having a plurality of openings 25A, the fitting plate 25 being mounted on the external face or internal face of the baffle plate.

In this case, the openings 25A provide air vents around the outer peripheral portion of the loudspeaker unit 13.

Figure 10:
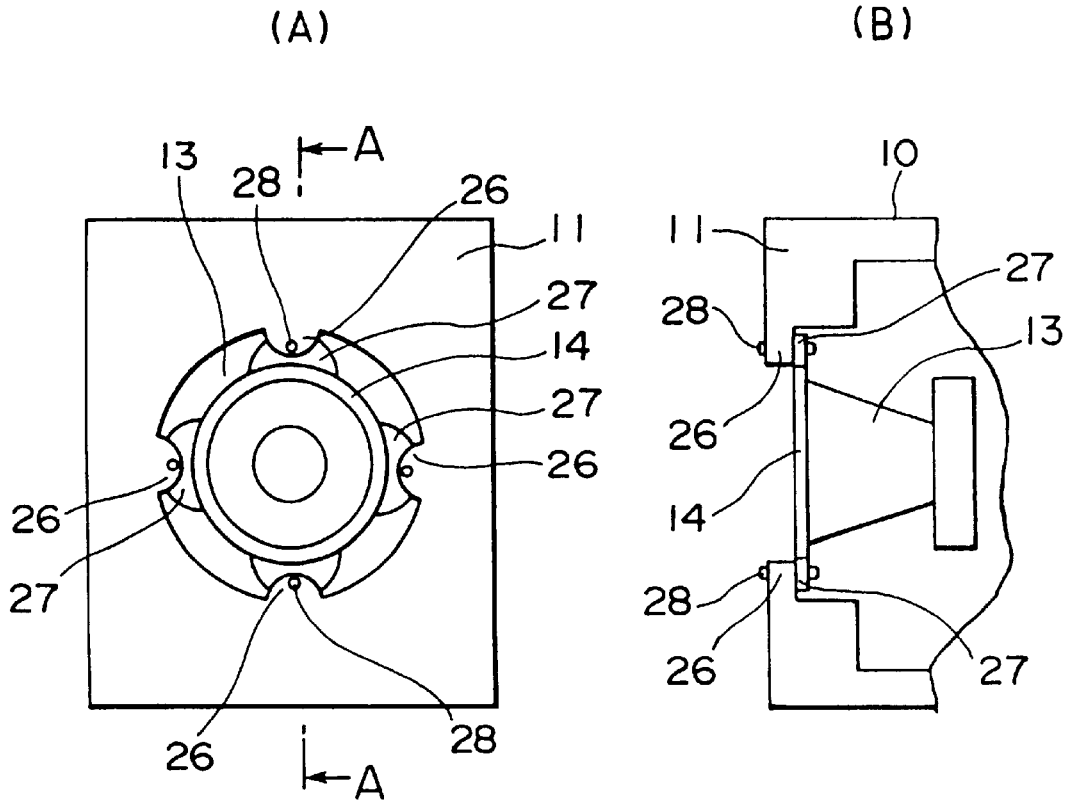
FIGS. 10(A) and 10(B) are front elevational view and a sectional view taken along a line A—A of FIG. 10(A), respectively, each showing an eighth embodiment.

FIGS. 10(A) and 10(B) area front elevational view and a sectional view, respectively, of a loudspeaker unit of a loudspeaker system in accordance with an eighth embodiment.

In this embodiment, a plurality of inwardly extending fitting protrusions 26 are formed around the inner peripheral surfaces of the opening 12 of the baffle plate 11, whereas a plurality of outwardly extending fitting protrusions 27 are formed around the outer peripheral surface of the loudspeaker unit 13 in order that the fitting protrusions 27 are fastened to the fitting protrusions 26 by means of machine screws 28 or the like.

In this embodiment, gaps are formed as air passages between the inner peripheral surface of the opening 12 and the outer peripheral portion of the loudspeaker unit 13.

According to the thus configured loudspeaker system, the outer peripheral site of the loudspeaker unit is provided with predetermined air passages formed along substantially the overall inner perimeter of the opening in the baffle plate, the air passages allowing a communication between the interior and exterior of the enclosure, whereby the following functions and effects are presented.

That is, the predetermined air passages allowing a communication between the interior and exterior of the enclosure serve as sound holes which through the bass reflex action radiate resonant sounds within the interior of the enclosure to reinforce the bass frequencies.

Influences on the diaphragm of inertial vibrations of the air spring lying within the enclosure are reduced and transient characteristics over the full reproduction range are improved, with the result that a free, easy and gloomless sound quality is obtained.

Furthermore, since the air passages are formed along the outer peripheral site of the loudspeaker unit so as to extend along substantially the overall inner perimeter of the opening in the baffle plate, air can flow in and out uniformly through the outer peripheral site of the loudspeaker unit and the coned paper of the loudspeaker unit can have a gentle curvature toward the air passages, with the result that the resistance to which the coned paper may be subjected as a result of a variation in the air pressure within the interior of the enclosure is effectively reduced, achieving an effective improvement in the quality of sounds.

In particular, since the air passages are formed in close vicinity to the loudspeaker unit and along substantially the overall inner perimeter of the opening in the baffle plate, it is possible to enhance the bass frequency characteristics as well as to prevent any turbulences of characteristics at the other frequencies.

By the way, in cases where the air passages are spaced apart from the loudspeaker unit to a great extent, there is a deficiency that although the bass frequency characteristics can be reinforced, the other frequencies may be subjected to any turbulences as set forth in connection with the prior art.

It has been found out that in the woofer unit or full-range unit, the optimal value can be conferred on the spatial volume provided equi-angularly between the periphery of the woofer unit frame and the baffle face by use of the spacers at the positions of the unit mounting screws, whereby the optimal spatial volume can serve as a regulator to control the air pressure within the enclosure. Furthermore, the quality of sounds from the sound generator has been improved by fixing the vibration body to the baffle face at several points in place of the surfaces.

It is thus possible to suppress any damping in the bass characteristics even when the mounting volume is smaller than the enclosure volume required by the loudspeaker unit, whereupon a small-sized enclosure can be used for the loudspeaker unit having a large-diameter diaphragm capable of high-efficient and high-withstand input, thereby simultaneously achieving an improvement in efficiency and a reduction in size of the loudspeaker system.

In particular, by forming the gaps acting as air passages with the intervention of a plurality of spacers between the internal face of the outer peripheral portion of the loudspeaker unit and the front face of the baffle plate or between the external face of the outer peripheral portion of the loudspeaker unit and the rear face of the baffle plate, the embodiments have the following advantages.

That is, the spacers can transmit vibrations of the loudspeaker unit frames to the baffle plate and act like the bridges of the contrabass, increasing the above resonance through the vibrations of the enclosure.

Also, depending on the design purposes, the spacers can be made of materials such as rubber or other resins having a large vibration absorptivity or of materials such as metals having a small vibration absorptivity so as to provide a control of the resonance of the baffle plate.

Furthermore, it is possible to form air vents at the outer peripheral portion of the loudspeaker unit by simple modifications such as addition of the spacers, alterations of shape of the opening in the baffle plate and alterations of shape of the outer peripheral portion of the loudspeaker unit, thereby eliminating a need to impart unique specifications to the loudspeaker unit itself, allowing an easy application to the existing loudspeaker systems, and providing cost-efficient loudspeaker unit structure without causing any complication and any increase in weight.

As shown in FIG. 1, in case of providing a bass reflex port by a bass reflex duct 29 or providing a bass radiation hole not shown for bass reflex, it is possible to raise the output sound pressure by employing a possible lowest resonance frequency of the bass reflex port or of the bass radiation hole.

The above embodiments of the first aspect of the present invention are applicable to loudspeaker systems provided in various types of acoustic equipment, especially to loudspeaker systems for SR systems, domestic audio loudspeaker systems, radio cassette players, sing-along machines, personal computers and television sets.

In the event of the loudspeaker units built into the wall surfaces or automobile doors in particular, the loudspeaker units can be mounted on the fitting portion (acting as the baffle plate) in accordance with the methods of the above embodiments.

Furthermore, in order to improve the external appearance, the openings of the air passages toward the exterior may be covered with a sound-permeable cloth or the like.

In case of aiming to reproduce a heavy low-frequency band, it is possible to effectively extend the bass reproduction limit frequency by further adding resonance ducts or adding motional feedback or equalizer operations to the loudspeaker systems including the loudspeaker units configured in accordance with the first aspect of the present invention.

The inventors have herein made experiments for comparing the loudspeaker system of the first aspect based on the following specifications (use of the spacers with the bass reflex duct or without the bass reflex duct) with the conventional loudspeaker system based on the above specifications (no use of the spacers without the bass reflex duct).

Loudspeaker System Specifications

A 38 cm dia. woofer unit ($f_o$=40 Hz) was mounted as the loudspeaker unit on a seal-up enclosure (inner dimensions: 90.8 cm (height)×45.2 cm (width)×44.2 cm (depth)) having an actual volume of 163 lit. (inner volume 181 lit.) in such a manner as to be spaced apart by a predetermined distance Rh from the baffle plate by means of the spacers as in the embodiments of FIGS. 1 and 2 for example.

While hearing musical signals, the spacer length was varied to 5 mm, 10 mm, 15 mm and 20 mm and the frequency characteristics and impedance characteristics were measured to obtain the optimum value of the predetermined distance Rh.

Furthermore, in order to improve the ultra-bass characteristics, two bass reflex ducts of e.g., 8 cm×38 cm (vinyl chloride pipe) were provided.

In such a case, an opening was formed at the lower portion of the baffle plate, and the pipe duct arranged horizontally within the enclosure was fixedly mounted in such a manner that its top opening communicates with the opening.

As a result, a communication was established via the bass reflex duct between the interior and the exterior of the enclosure.

Figure 11:
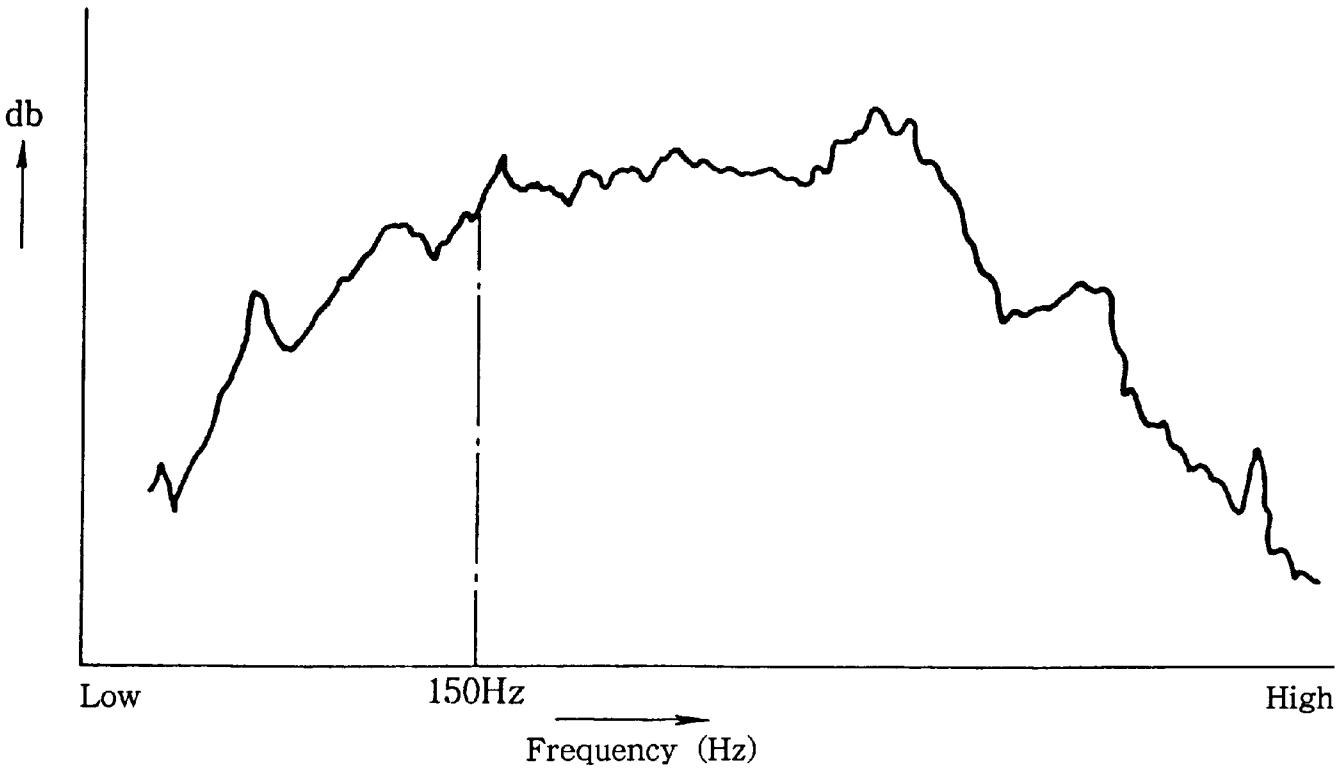
FIG. 11 is a graphic representation showing the results of experiments on frequency characteristics of a conventional loudspeaker system.

In case of the seal-up enclosure, the ideal value of the actual volume of the 38 cm dia. woofer unit used was 225 lit although its actual volume was 165 lit. (72.4% of the ideal value) as described above. The conventional loudspeaker system exhibited a low-frequency characteristic damping from 150 Hz onward as seen in FIG. 11 since the large-diameter loudspeaker unit having a larger S0 was mounted on the enclosure short of volume.

Sound qualities lacking low-frequency weightiness and mid-frequency clearness were thus created, making high fidelity reproduction use difficult.

Figure 12:
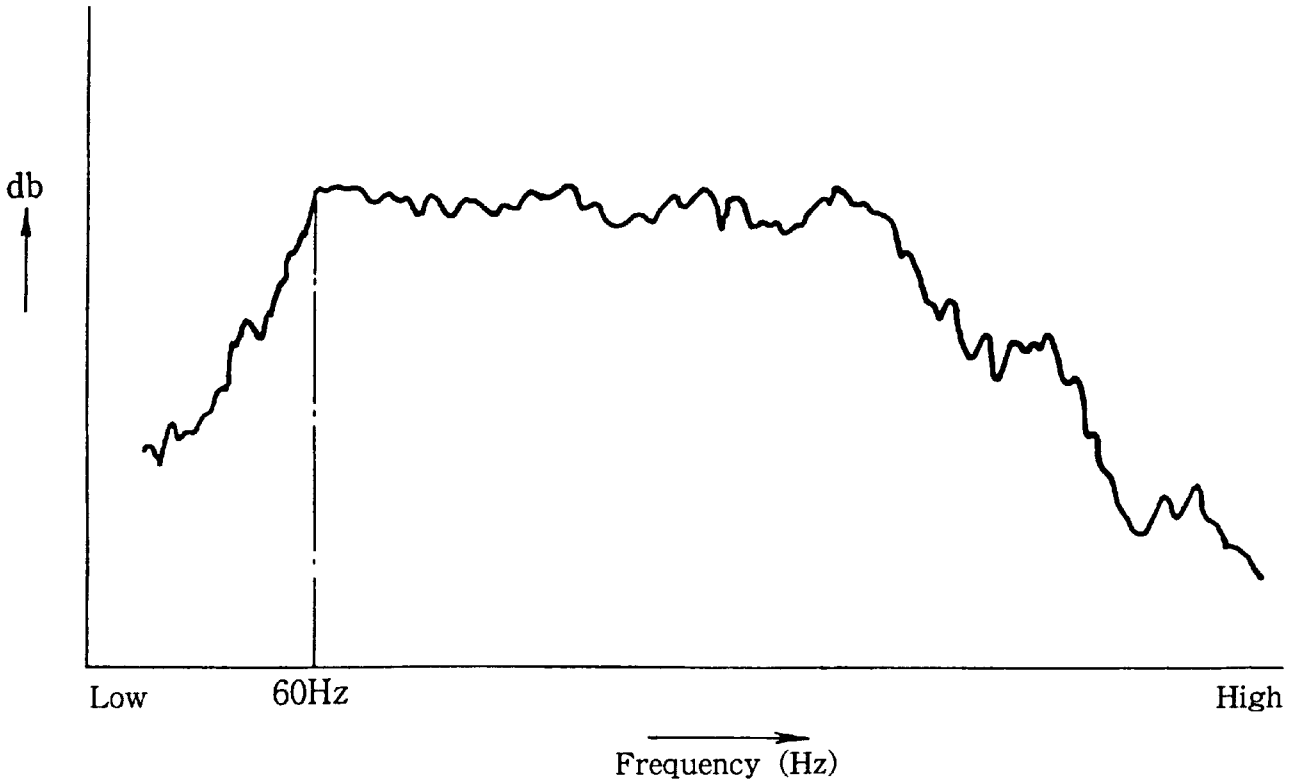
FIG. 12 is a graphic representation showing the results of experiments on frequency characteristics of the loudspeaker system in accordance with the first aspect of the present invention.

The loudspeaker system (using 15 mm spacers without the bass reflex duct) in accordance with the first aspect of the present invention presented a substantially flat characteristic till 60 Hz as illustrated in the graph of FIG. 12.

Figure 13:
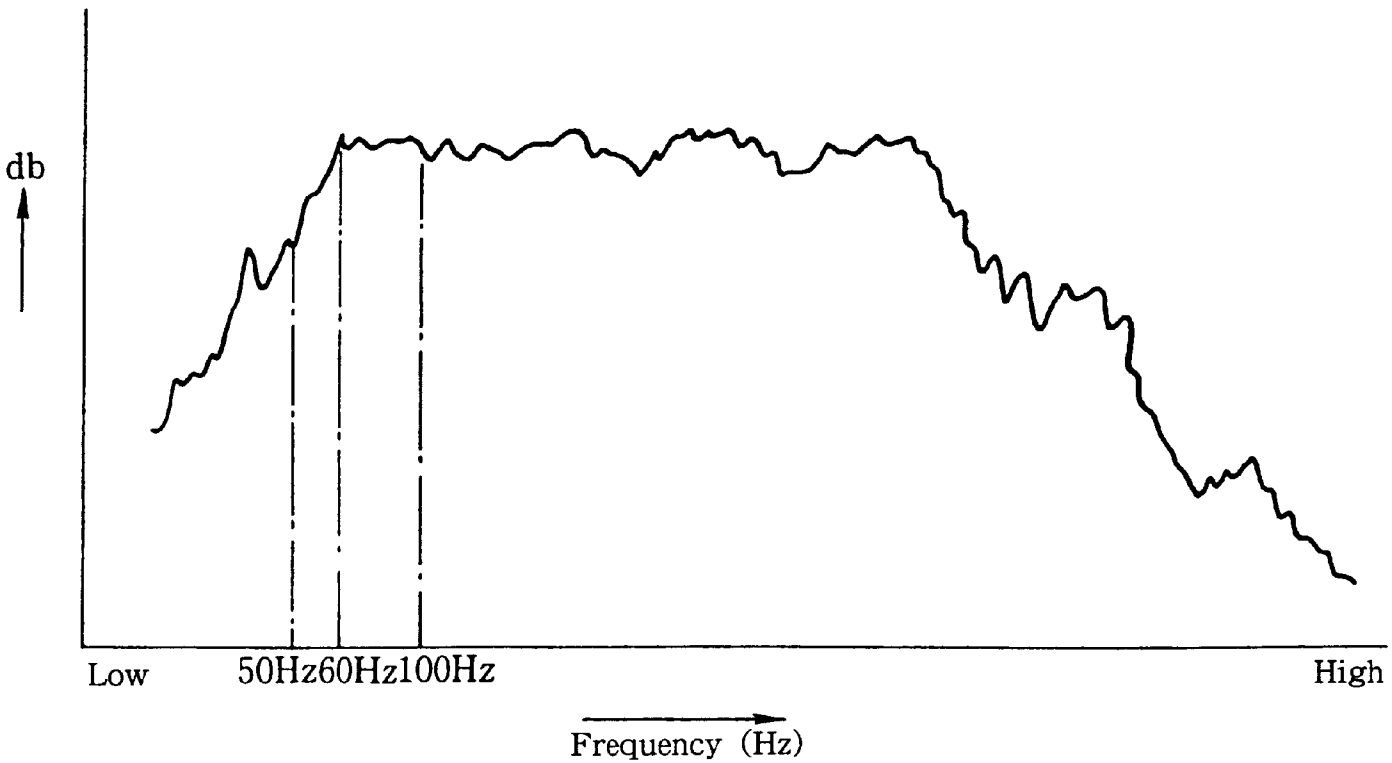
FIG. 13 is a graphic representation showing the results of experiments on frequency characteristics of the loudspeaker system in accordance with the first aspect of the present invention.

The loudspeaker system (using 10 mm spacers with two 8 cm×38 cm bass reflex ducts (the bass reflex ducts have as large a length as possible so that they can reach the full depth of the enclosure)) in accordance with the first aspect of the present invention provided quite a flat frequency characteristic between 60 Hz to 100 Hz with the bass reproduction limit at 6 db down value being 50 Hz as illustrated in the graph of FIG. 13.

Thus, this loudspeaker system was able to reproduce sounds of bass instruments such as contrabasses in jazz or classical music naturally and in a realistic manner without causing any distortive feelings, indistinctness or exaggerations. At the same time, remarkably improved were tones of high-frequency noise components which may occur when plucking strings characteristic of pizzicato or electric bass glissando.

It has also turned out that by the combination of the loudspeaker unit having a small stiffness $S_0$ and having a large effective vibrational mass $M_0$ and the configuration of the first aspect of the present invention (using the spacers), a further reduction in system dimensions (about 30% reduction at the enclosure volume ratio upon the use of the current loudspeaker unit of the same type) can easily be achieved at lower costs without degrading any bass characteristics.

In the above, description has been made of the 38 cm dia. loudspeaker unit. Then, while hearing musical signals, the frequency characteristics and impedance characteristics were measured to obtain optimal values of the predetermined distance Rh from the baffle plate in the loudspeaker units having the other diameters (e.g., of 30 cm).

Furthermore, the inventors has done experiments (1) to (3) which follow.

(1) For a small diameter loudspeaker unit, air vents were formed in the enclosure by use of spacers to examine the quality of sounds.

(2) For a middle diameter loudspeaker unit of the order of 20 cm dia., air vents were formed in the enclosure by use of spacers to examine the quality of sounds.

The spacers for use in this case were each in the shape of a washer of the order of 1 mm thick.

The results of those experiments revealed that five-degree lower tones in the musical scale notation can be reproduced as well as enhanced feelings of separation of instruments, depths and real existences.

In the event that the volume of the enclosure is reduced to one-several-th of $V_{as}$ of the loudspeaker unit, it is preferred that the interior of the enclosure be filled with an acoustic material in order to reduce the internal impedance of the enclosure.

In this case, rather than the effect of resonance of the enclosure, an effect is especially expected that there may be reduced the influence on the diaphragm of the inertial vibrations of the air spring lying within the enclosure.

(3) For a three-way loudspeaker system having separate loudspeaker units for low-frequency sounds, mid-frequency sounds and high-frequency sounds, air vents were formed in the enclosure by use of the spacers to examine the quality of sounds.

According to the results of this experiment, any improvement in the quality of sounds has been found out in all of the loudspeaker units for low-frequency sounds, mid-frequency sounds and high-frequency sounds.

That is, the first aspect of the present invention contributes to improvements in the quality of sounds not merely in the low-frequency sound loudspeaker unit but also in the middle and high- frequency sound loudspeaker units.

A second aspect of the present invention will then be described.

The basic concept of the second aspect is as follows.

The problems of loudspeaker size reduction and its attendant degradation in bass frequency characteristics can be solved by isolating the diaphragm of the loudspeaker unit from any influence of damping which may be caused by the air spring lying within the enclosure.

For example, a stringed instrument such as a guitar or a contrabass can produce excellent basses or low-frequency sounds under the action of its resonance box although it merely has vibrating elements with minute surface areas in the form of strings. It can also produce extremely rich harmonics providing overtone components.

This is due to the fact that vibrations of the strings acting as the vibrating elements are transmitted via the bridges to the resonance box so as to utilize the resonance of the body as much as possible.

As is apparent from this example, the enclosure can be used as the resonance box in order to achieve most simple and effective reproduction of basses by the loudspeaker system.

Thus, in the second aspect of the present invention, the outer peripheral site of the loudspeaker unit is provided with predetermined air passages extending along substantially the overall inner perimeter of the baffle plate opening, for allowing a communication between the interior and exterior of the enclosure, and the loudspeaker unit is located apart from the opening, e.g., to such an extent as to prevent an occurrence of degradation of bass frequency characteristics arising from detouring of the basses without any intimate contact with the baffle plate opening surface of the enclosure, to thereby obviate any influences on the diaphragm of the air spring lying within the enclosure to consequently achieve an effective use of the enclosure as the resonance box.

The second aspect of the present invention aims for example to extend the low-frequency characteristics and to improve the quality of sounds over the full ranges for a bass loudspeaker including a flame rib which acts as the fitting surface to the baffle plate but has no even annular shape or including the fitting surface having a small area due to its small diameter, wherein it may be difficult to easily and securely regulate the gaps formed along substantially the overall inner perimeter of the baffle plate opening between the rear face of the outer peripheral portion of the loudspeaker unit and the front face of the baffle plate.

In the mid-frequency sound loudspeaker system and the high-frequency sound loudspeaker system, for the purpose of improving the auditory localization of image sounds through the radiation of sounds within the enclosure from the periphery thereof, a large-diameter annular rim is mounted on the rear face or front face of the outer peripheral portion of the loudspeaker unit so that confronting areas are increased of both the rear face or the front face of the outer peripheral portion of the loudspeaker unit and the front face or the rear face of the baffle plate, thereby ensuring an appropriate resistance of air flowing through the gaps to prevent any degradation of the low-frequency characteristics.

Description will then be made of embodiments of the loudspeaker system based on such a basic concept of the second aspect of the present invention.

Figure 14:
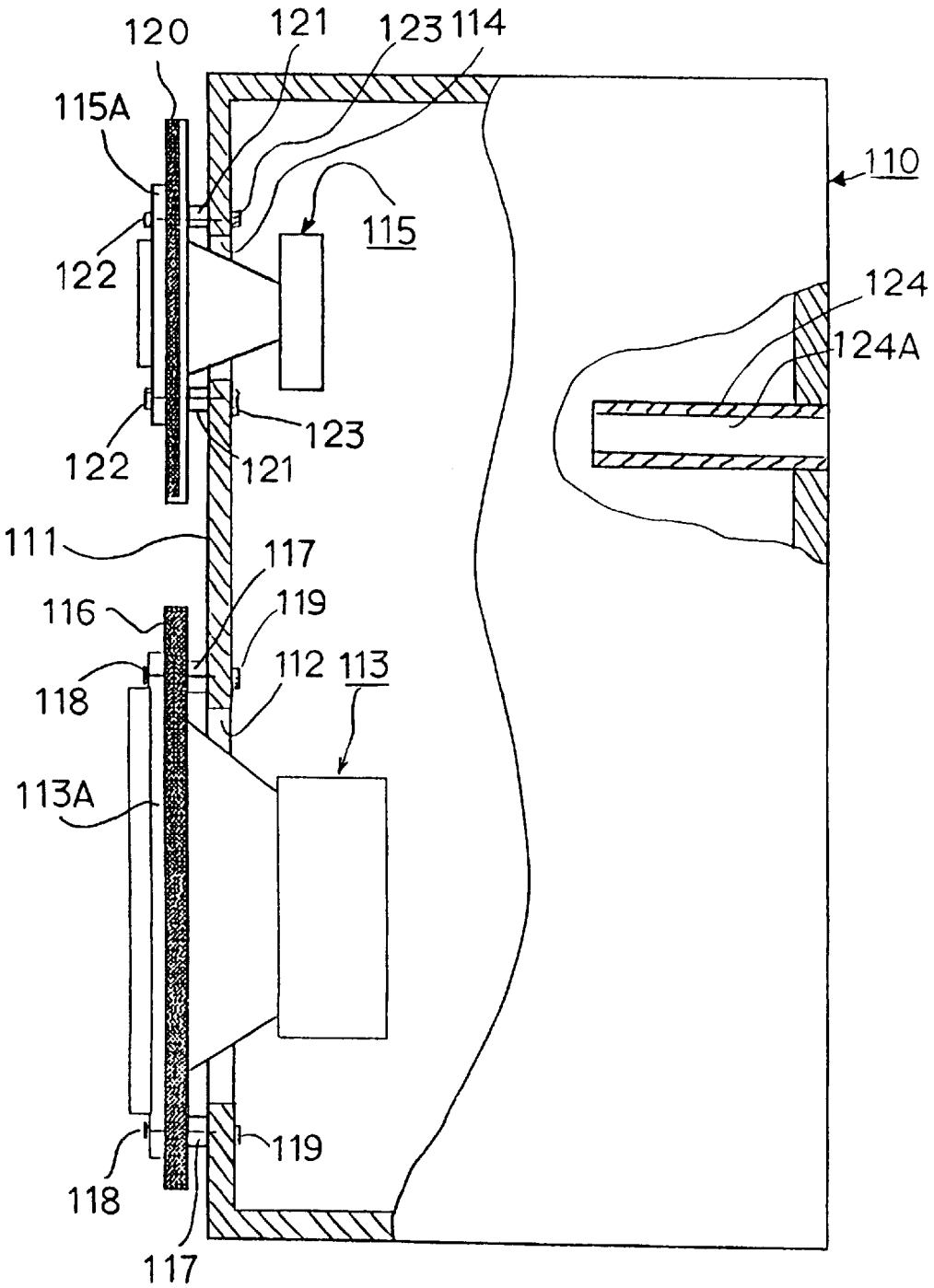
FIG. 14 is a longitudinal sectional view of a first embodiment of a loudspeaker system in accordance with a second aspect of the present invention.

FIG. 14 is a longitudinal sectional view of the loudspeaker system in accordance with a first embodiment.

In this diagram, the loudspeaker system comprises an enclosure 110, a loudspeaker unit 113 for low-frequency sounds fitted to an opening 112 in a baffle plate 111 situated at the front of the enclosure 110, and a loudspeaker unit 115 for high-frequency/mid-frequency sounds fitted to an opening 114.

The loudspeaker unit 113 for low-frequency sounds is mounted on the baffle plate 111 in such a manner that gaps are formed between an annular rim 116 fitted to the rear face of a flange 113A at the outer peripheral portion of the loudspeaker unit 113 and the front face of the baffle plate 111, the gaps providing predetermined air passages allowing a communication between the interior and the exterior of the enclosure 110.

In this embodiment, a plurality of tubular spacers 117 are interposed between the internal face of an annular rim 116 on the rear face of the flange 113A at the outer peripheral portion of the loudspeaker unit 113 for low-frequency sounds and the front face of the baffle plate 111 so that the loudspeaker unit 113 for low-frequency sounds is secured to the baffle plate 111 by means of machine screws 118 acting as fittings for insertion into the spacers 117.

In this case, eight screw insertion holes are formed in equi-angularly spaced manner in both the annular rim 116 on the flange 113A at the outer peripheral portion of the loudspeaker unit 113 for low-frequency sounds and in the perimeter of the opening in the baffle plate 111, the machine screws 118 being inserted through the insertion holes associated with the loudspeaker unit 113 for low-frequency sounds, through holes in the annular rim 116, through holes in the spacers 15 and through the insertion holes associated with the baffle plate 111 in the mentioned order, after which nuts 119 are screwed and tightened onto ends, protruding from the rear face of the baffle plate 111, of threaded leading portions of the machine screws 118.

On the other hand, the unit 115 for high-frequency/mid-frequency sounds is mounted on the baffle plate 111 in such a manner that gaps are formed between an annular rim 120 fitted to the rear face of a flange 115A at the outer peripheral portion of the unit 115 and the front face of the baffle plate 111, the gaps providing predetermined air passages allowing a communication between the interior and the exterior of the enclosure 110.

In this embodiment, a plurality of tubular spacers 121 are interposed between the internal face of an annular rim 120 on the rear face of the flange 113A at the outer peripheral portion of the loudspeaker unit 115 for high-frequency/mid-frequency sounds and the front face of the baffle plate 111 so that the loudspeaker unit 115 for high-frequency/mid-frequency sounds is secured to the baffle plate 111 by means of machine screws 122 acting as fittings for insertion into the spacers 121 and by means of nuts 123 mating therewith.

The spacers 117 and 121 for use herein can be made of, e.g., a rigid material such as metals (vibration transmission type), or a resilient material or member such as rubbers or coil springs (vibration absorption type).

It is preferred in case of the vibration absorption spacers that between the nuts 119, 123 and the baffle plate 111 there intervene a washer made of rubber or other resilient material.

In the diagram, reference numeral 124A denotes a bass reflex port provided by a bass reflex duct 124.

Figure 15:
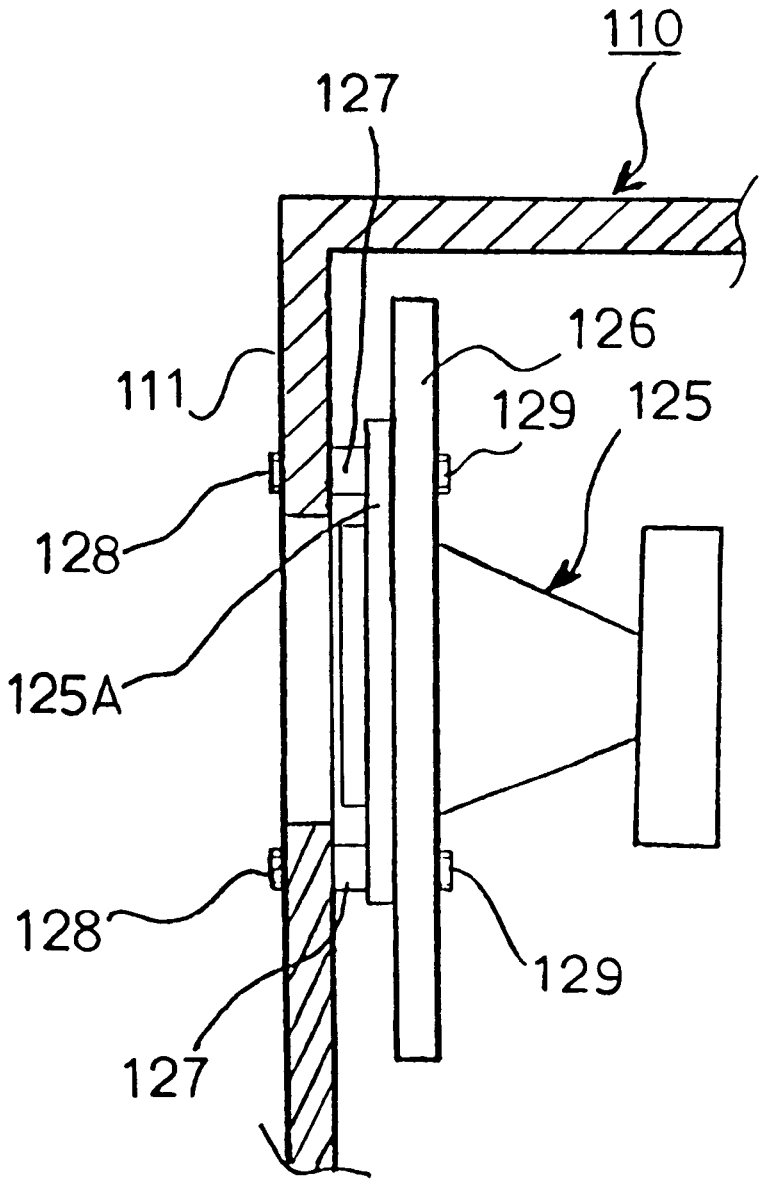
FIG. 15 is a longitudinal sectional view of a second embodiment of the same.

FIG. 15 is a longitudinal sectional view of a loudspeaker system in accordance with a second embodiment.

In this embodiment, the loudspeaker unit 125 is mounted in such a manner that there are formed gaps having a predetermined distance between the external face of the annular rim 126 situated on the front face of the flange 125A of the loudspeaker unit 125 and the rear face of the baffle plate 111.

That is, a plurality of spacers 127 are interposed between the annular rim 126 attached to the front face of the flange 125A of the loudspeaker unit 125 and the rear face of the baffle plate 111 so that the loudspeaker unit 125 is fitted to the baffle plate 111 by means of machine screws 128 inserted through the spacers 127 and by means of nuts 129 mating therewith.

It will be understood that the spacers 117, 121 and 127 may be formed integrally with the annular rims 116, 120 and 126 or with the baffle plate 111.

For example, the baffle plate 111 may previously have a plurality of spacer portions formed integrally therewith so that the annular rims 116, 120 and 126 associated with the loudspeaker units 113, 115 and 125 can be attached to the spacer portions.

For this attachment, rivets or split pins can be used. Alternatively, use may be made of pins and C-rings fitted into the pins.

FIGS. 16(A) and 16(B) are a front elevational view and a side elevational view, respectively, of a loudspeaker unit of a loudspeaker system in accordance with a third embodiment.

In this embodiment, the loudspeaker unit generally designated at 130 is provided integrally with an annular rim 131, with a plurality of spacer portions 132 projecting backward from the rear face of the annular rim 131 and with a ring-like rib 133 located behind the rear face of the annular rim 131 for coupling the spacer portions 132 with one another, the rib 133 being fastened to the baffle plate front face by means of machine screws and nuts.

Although not shown, the annular rim associated with the loudspeaker unit may be provided integrally with a plurality of spacer portions projecting forwardly from the front face of the annular rim, and with a ring-like rib positioned in front of the front face of the annular rim for coupling the spacer portions together, the rib being fastened to the baffle plate rear face by means of machine screws and nuts.

According to the thus configured loudspeaker system, the outer peripheral site of the loudspeaker unit is provided with predetermined air passages formed along substantially the overall inner perimeter of the opening in the baffle plate, the air passages allowing a communication between the interior and exterior of the enclosure, whereby the following functions and effects are presented.

That is, the predetermined air passages allowing a communication between the interior and exterior of the enclosure serve as sound holes which through the bass reflex action radiate resonant sounds within the interior of the enclosure to reinforce the bass frequencies.

Influences on the diaphragm of inertial vibrations of the air spring lying within the enclosure are reduced and transient characteristics over the full reproduction range are improved, with the result that a free, easy and gloomless sound quality is obtained.

Furthermore, since the air passages are formed along the outer peripheral site of the loudspeaker unit so as to extend along substantially the overall inner perimeter of the opening in the baffle plate, air can flow in and out uniformly through the outer peripheral site of the loudspeaker unit and the coned paper of the loudspeaker unit can have a gentle curvature toward the air passages, with the result that resistance to which the coned paper may be subjected as a result of a variation in the air pressure within the interior of the enclosure is effectively reduced, achieving an effective improvement in the quality of sounds.

In particular, since the air passages are formed in close vicinity to the loudspeaker unit and along substantially the overall inner perimeter of the opening in the baffle plate, it is possible to enhance the bass frequency characteristics as well as to prevent any turbulences of characteristics at the other frequencies.

By the way, in cases where the air passages are not equi-angularly arranged and are spaced from one another to a considerable extent, there is a deficiency that although the bass frequency characteristics can be reinforced, the other frequencies may be subjected to any turbulences as set forth in connection with the prior art.

It has been found out that in the woofer unit or full-range unit, the optimal value can be conferred on the spatial volume provided equi-angularly between the periphery of the woofer unit frame and the baffle face by use of the spacers at the positions of the unit mounting screws, whereby the optimal spatial volume can serve as a regulator to control the air pressure within the enclosure. Furthermore, the quality of sounds from the sound generator has been improved by fixing the vibration body to the baffle face at several points in place of the surface of the vibration body.

It is thus possible to suppress any damping in the bass characteristics even when the mounting volume is smaller than the enclosure volume required by the loudspeaker unit, whereupon a small-sized enclosure can be used for the loudspeaker unit having a large-diameter diaphragm capable of high-efficient and high-withstand input, thereby simultaneously achieving an improvement in efficiency and a reduction in size of the loudspeaker system.

In particular, by virtue of providing the rear face or front face of the outer peripheral portion of the loudspeaker unit with the annular rim for regulating the confronting areas of the rear face or front face of that outer peripheral portion and of the front face or rear face of the baffle plate, the following functions and effects are presented.

For a bass loudspeaker including a flame rib which acts as the fitting surface to the baffle plate but has no even annular shape or including a small fitting surface area wherein it may be difficult to regulate the gaps formed along substantially the overall inner perimeter of the baffle plate opening between the rear face of the outer peripheral portion of the loudspeaker unit and the front face of the baffle plate, a large-diameter annular rim is mounted on the front face or rear face of the outer peripheral portion of the loudspeaker unit so as to increase the confronting areas of the rear face or front face of the outer peripheral portion and of the front face or rear face of the baffle plate, whereby there can easily be achieved an enhancement in the low-frequency characteristics and an improvement in the quality of sounds over the full range.

That is, through any regulation of the area of the annular rim to regulate the volume of the gap lying between the baffle plate and the annular rim, control is provided of the mass of air passing through the gap and of the resistance upon the passage so as to ensure the optimum action of the loudspeaker unit diaphragm, whereby the amount of air discharge and intake is added to the additional mass of the diaphragm, thus presenting a function to lower the minimum resonance frequency. Simultaneously, air around the diaphragm is discharged and taken in circumferentially evenly and with an appropriate resistance whereupon the force of the piston action exerted on the voice coil and its vicinity can reach up to the periphery of the diaphragm in a well-balanced manner, thus preventing any possible abnormal diaphragm vibrations, lowering the enclosure stiffness, blocking a rise of Q of the voice coil, as well as providing effectively improved low frequency characteristics.

In the mid-frequency sound loudspeaker system and the high-frequency sound loudspeaker system, for the purpose of improving the auditory localization of image sounds through the radiation of sounds within the enclosure from the periphery thereof, a large-diameter annular rim is mounted on the rear face or front face of the outer peripheral portion of the loudspeaker unit so as to increase the confronting areas of both the rear face or the front face of the outer peripheral portion of the loudspeaker unit and the front face or the rear face of the baffle plate, thereby making it possible to prevent the low-frequency characteristics from being degraded.

In other words, in the mid-frequency sound loudspeaker system and the high-frequency sound loudspeaker system, through the regulation of the volume of the gap lying between the baffle plate and the annular rim, it is possible to prevent bass outputs of the entire loudspeaker system from becoming lower by the actions of the mass of air passing through the gap and of the resistance upon the passage.

Figure 17:
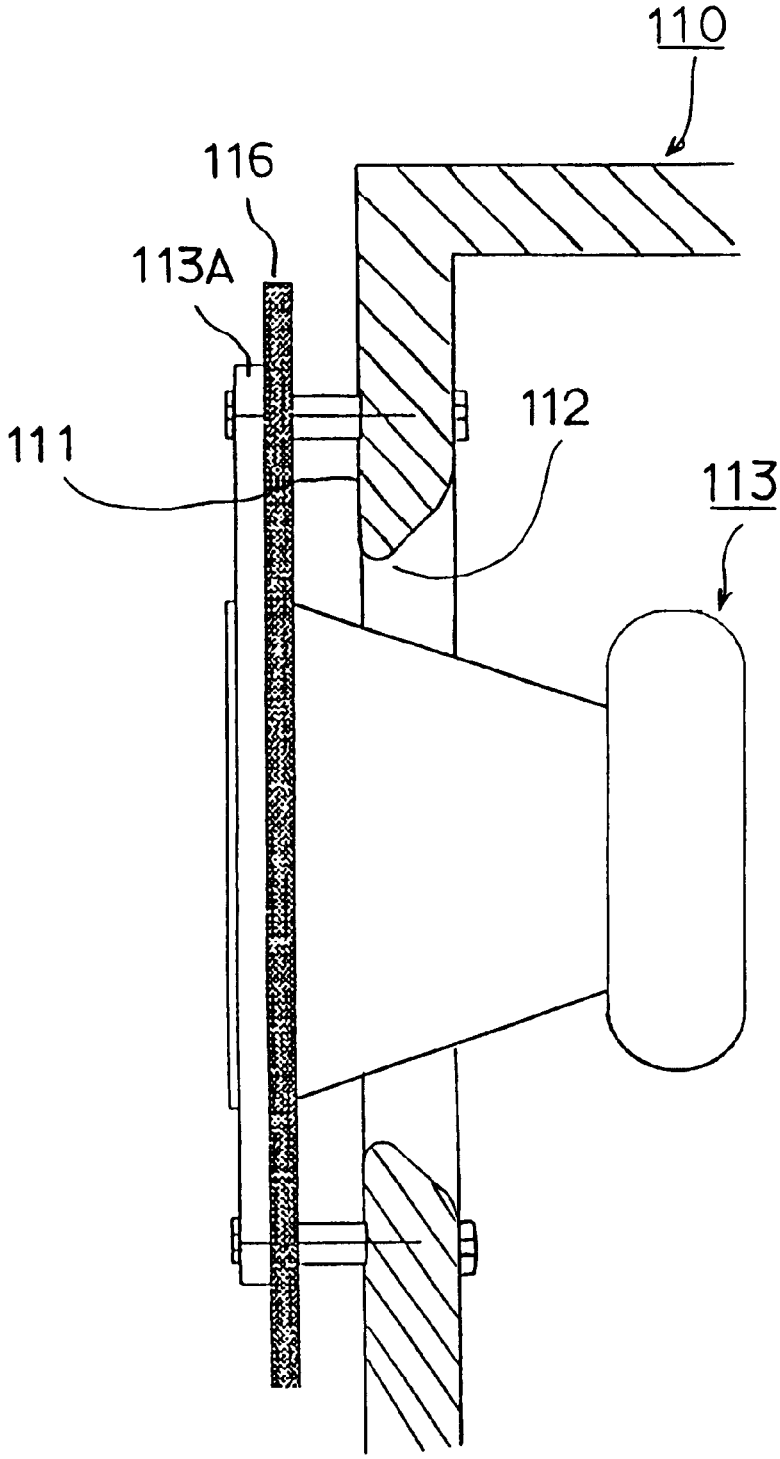
FIG. 17 is a longitudinal sectional view showing a fourth embodiment.

In such a case, for the purpose of ensuring a smooth air inflow and outflow at the opening in the baffle plate, it is preferred in any loudspeaker units for low-frequency sounds, mid-frequency sounds and high-frequency sounds to countersink the surface of the opening 112 in the baffle 111 on the internal side of the enclosure 110 to a considerable extent (countersunk portion 112A) as in a fourth embodiment shown in FIG. 17 for example and to roundly chamfer the surface confronting the outer peripheral portion of the loudspeaker unit 113, thereby obviating the function of rectification of air passing through the gap whose dimensions have been reduced as a result of the provision of the annular rim 116, to consequently prevent the occurrence of any distortions.

As described hereinabove, the addition of the annular rim enables the length of the air passages to be adjusted in an appropriate manner through the regulation of the gaps formed along substantially the overall inner perimeter of the opening in the baffle plate between the rear face of the outer peripheral portion of the loudspeaker unit and the front face of the baffle plate, whereupon it is possible to suppress any reduction in the additional mass on the loudspeaker unit diaphragm arising from the internal air when the volume of the enclosure is smaller than the volume required by the woofer unit as well as to suppress any damping in the bass reproduction characteristics. This will especially be effective in the small-sized loudspeaker system in which its additional mass on the loudspeaker unit diaphragm is liable to lower and in which its bass reproduction characteristics are apt to damp.

The following advantages are presented by the embodiments which include gaps providing air passages and formed by the interposition of the plurality of spacers between the internal face of the annular rim associated with the loudspeaker unit and the baffle plate front face or between the external face of the annular rim and the baffle plate rear face.

That is, the spacers can transmit vibrations of the loudspeaker unit frames to the baffle plate and act like the bridges of the contrabass, adding to the above resonance through the effective vibrations of the enclosure.

Also, depending on the design purposes, the spacers can be made of materials such as rubber or other resins having a large vibration absorptivity or of materials such as metals having a small vibration absorptivity so as to provide a control of the resonance of the baffle plate.

Furthermore, it is possible to form air vents at the outer peripheral portion of the loudspeaker unit by simple modifications such as addition of the spacers, alterations of shape of the opening in the baffle plate and alterations of shape of the outer peripheral portion of the loudspeaker unit, thereby eliminating a need to impart unique specifications to the loudspeaker unit itself, allowing an easy application to the existing loudspeaker systems, and providing cost-efficient loudspeaker unit structure without causing any complication and any increase in weight.

As shown in the embodiment of FIG. 14, in case of providing a bass reflex port 124A by a bass reflex duct 124 or providing a bass radiation hole for bass reflex, it is possible to lower the lowest frequency band as compared with the ordinary bass reflex type by imparting as low a resonance frequency as possible to the bass reflex ports or the bass radiation holes.

Figure 16:
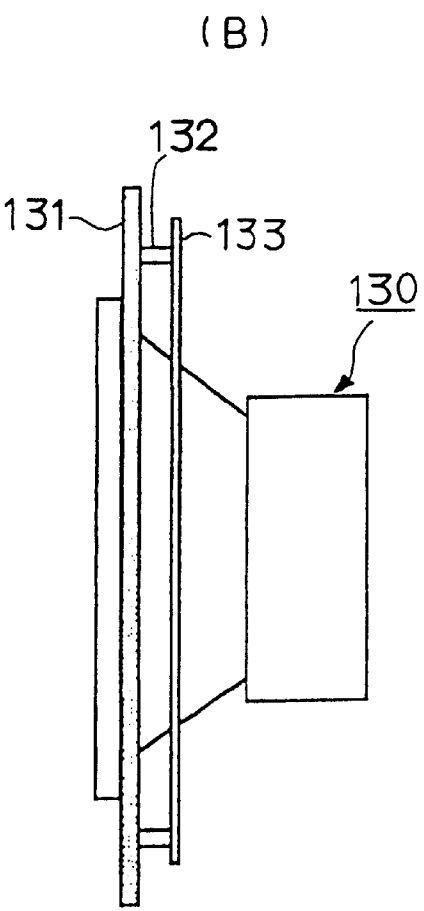
FIGS. 16(A) and 16(B) are a front elevational view and a side elevational view, respectively, each showing a third embodiment of the same.
Figure 16:
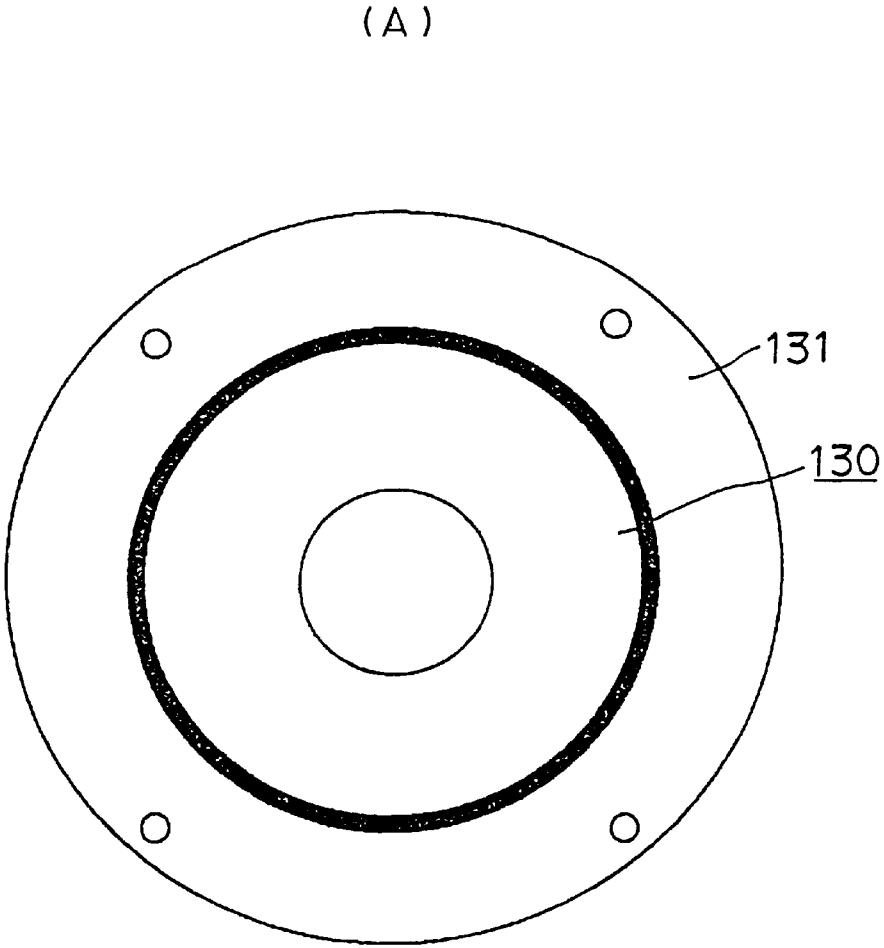

Furthermore, by employing the structure including the annular rim and spacers which are previously formed integrally with the loudspeaker unit itself as in the embodiment of FIG. 16, the number of parts of the apparatus can totally be reduced. Application of the second aspect of the present invention to the loudspeaker system will thus become possible by the attachment of only the loudspeaker unit, contributing to fabrication easiness.

The above embodiments of the second aspect of the present invention are applicable to loudspeaker systems provided in various types of acoustic equipment, especially to loudspeaker systems for SR systems, domestic audio loudspeaker systems, radio cassette players, sing-along machines, personal computers and television sets.

In the event of the loudspeaker units built into the wall surfaces or automobile doors in particular, the loudspeaker units can be mounted on the fitting portion (acting as the baffle plate) in accordance with the methods of the above embodiments.

Furthermore, in order to improve the external appearance, the openings of the air passages toward the exterior may be covered with a sound-permeable cloth or the like.

In case of aiming to reproduce a heavy low-frequency band, it is also possible to effectively extend the bass reproduction limit frequency by further adding resonance ducts or adding motional feedback or equalizer operations to the loudspeaker systems including the loudspeaker units configured in accordance with the second aspect of the present invention.

Figure 18:
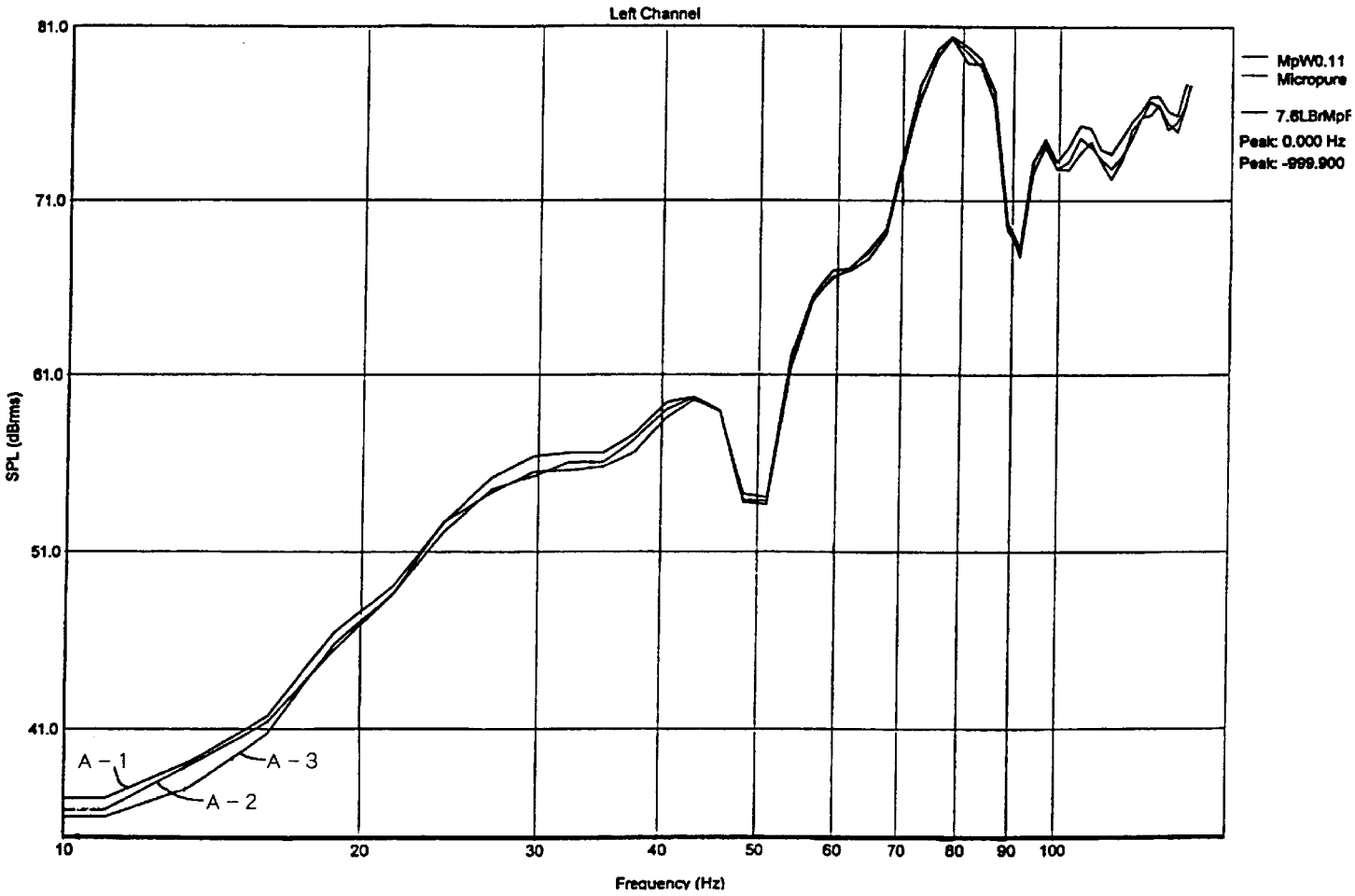
FIG. 18 is a graphic representation showing the results of experiments on frequency characteristics of a conventional loudspeaker system and of the loudspeaker system of the present invention.

The inventors have herein made experiments for comparing among a loudspeaker system A-1 of the second aspect based on the following specifications (use of the spacers with the annular rim), a conventional loudspeaker system A-2 based on the following specifications (use of only the spacers) and a conventional loudspeaker system A-3 (no use of the spacers and annular rim) (see a characteristic diagram of FIG. 18 showing the results of the experiments).

Loudspeaker System Specifications

A 13 cm dia. woofer unit ($f_o$=80 Hz) was mounted as the loudspeaker unit on a bass reflex type enclosure (inner dimensions: 26.7 cm (height)×16.4 cm (width)×17.3 cm (depth)) having an actual volume of 7.6 lit. in a manner spaced apart by a predetermined distance Rh (0.11 mm) from the baffle plate by means of the spacers.

While hearing musical signals, the frequency characteristics and impedance characteristics were measured to obtain the optimum value of the predetermined distance Rh.

Furthermore, a bass reflex duct providing $F_{o'}$=55.05 Hz was employed from calculations and experiments under ordinary bass reflex actions. As a result, a 2.9 cm (i.d.) ×7 cm pipe duct was mounted on the back of the enclosure. The interior sound absorption processing was merely done in the form of adhesion of a rough felt of the order of 5 mm in thickness to the inner bottom of the enclosure.

As is apparent from the characteristic diagram of FIG. 18, in the loudspeaker unit (A-1) in case of attachment of a 170 mm dia. 3 mm thick acrylic annular rim to the loudspeaker unit frames, the low-frequency band from 10 Hz to 42 Hz had a higher output by 1 db than the bass reflex type loudspeaker system (A-3) in which the conventional unit was mounted on the baffle in an intimate contact manner. If the loudspeaker system has a 3 db lower reproduction efficiency, then double the output of the power amplifier to be operated will be needed to acquire the same sound pressure. This will correspond to an improvement of the order of 33% for the amplifier.

In case of the conventional loudspeaker system (A-2) having no annular rim, some frequency bands presented degraded bass characteristics as compared with the loudspeaker system (A-3), although in case of attachment of the annular rim, any bass output lower than the loudspeaker system (A-3) was not found over the low-frequency band from 10 Hz to 42 Hz.

The conventional bass reflex type was unable to have such a low $f_{o'}$ since the bass tended to show descending characteristics. In this experiments, however, improvements of +3 db and +4 db were found in the bands ranging from 15 Hz to 35 Hz and from 58 Hz to 79 Hz, respectively, with a lower $f_{o'}$ being 55.05 Hz, as compared with the product of $f_{o'}$=67 Hz which was designed under the same conditions by the manufacturer in accordance with the ordinary bass reflex type design method.

The inventors further made the following experiment.

In case of a two-way loudspeaker system in accordance with present application (the same will apply to three-way and four-way loudspeaker systems), not only the woofer but also the tweeter needs to be lifted in order to ensure good tone balances and natural feelings of sounds of waves or the like. Furthermore, with the tweeter lifted, sounds from the woofer within the enclosure had better be radiated from the periphery of the tweeter in order to improve the auditory localization. For this reason, the present applicant simply mounted the tweeter apart from the baffle plate in the prior application.

However, this may possibly permit any leak of air from the periphery of the tweeter to impair the effect of the bass reflex duct, eventually lowering the bass reproduction capacity of the loudspeaker system.

Thus, according to the result of the experiment on the configuration employing the second aspect of the present invention, for example, on the configuration in which the tweeter fitted to an 80 mm dia. 3 mm thick acrylic annular rim is threadedly mounted via spacers made of thin films (e.g., wraps) in a manner spaced apart from the baffle plate by about 0.01 mm, it has turned out that similar sound effects are obtained and any degradation in bass characteristics is prevented. Furthermore, peaks and valleys in the high-frequency characteristics were flattened to obtain smoother characteristics.

The results of such experiment are shown in FIGS. 19 to 24 which are characteristic diagrams of two-way loudspeaker system complete models 1 to 3 in accordance with the present application.

Figure 19:
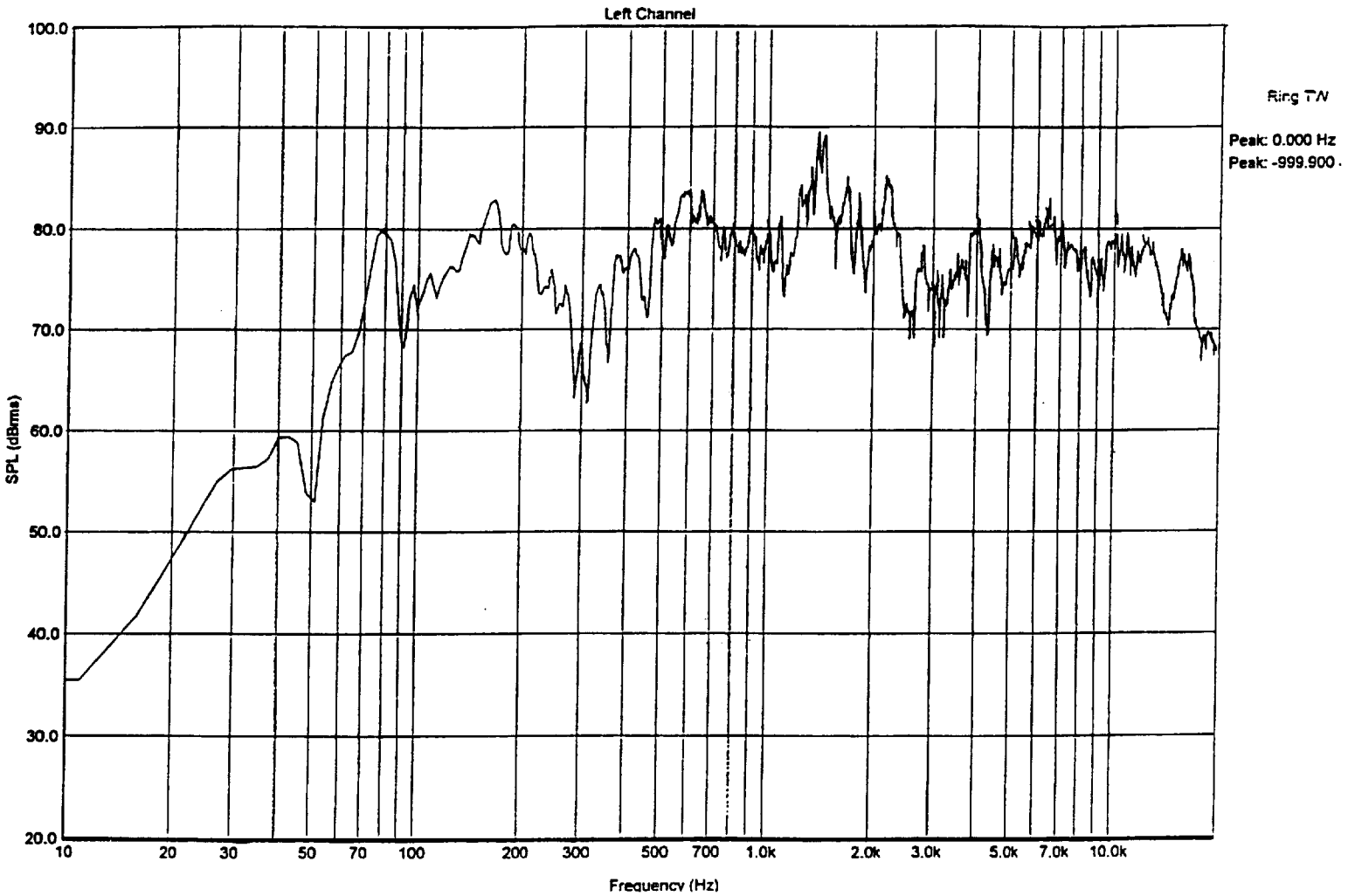
FIG. 19 is a graphic representation showing the results of experiments on frequency characteristics of the loudspeaker system in accordance with the second aspect of the present invention.

FIG. 19 is a characteristic diagram of a model B-1 using an 80 mm dia. 3 mm thick acrylic annular rim so that the tweeter is mounted 0.01 mm apart from the baffle plate and using a 170 mm dia. 3 mm thick acrylic annular rim so that the woofer is mounted 0.11 mm apart from the baffle plate.

Figure 20:
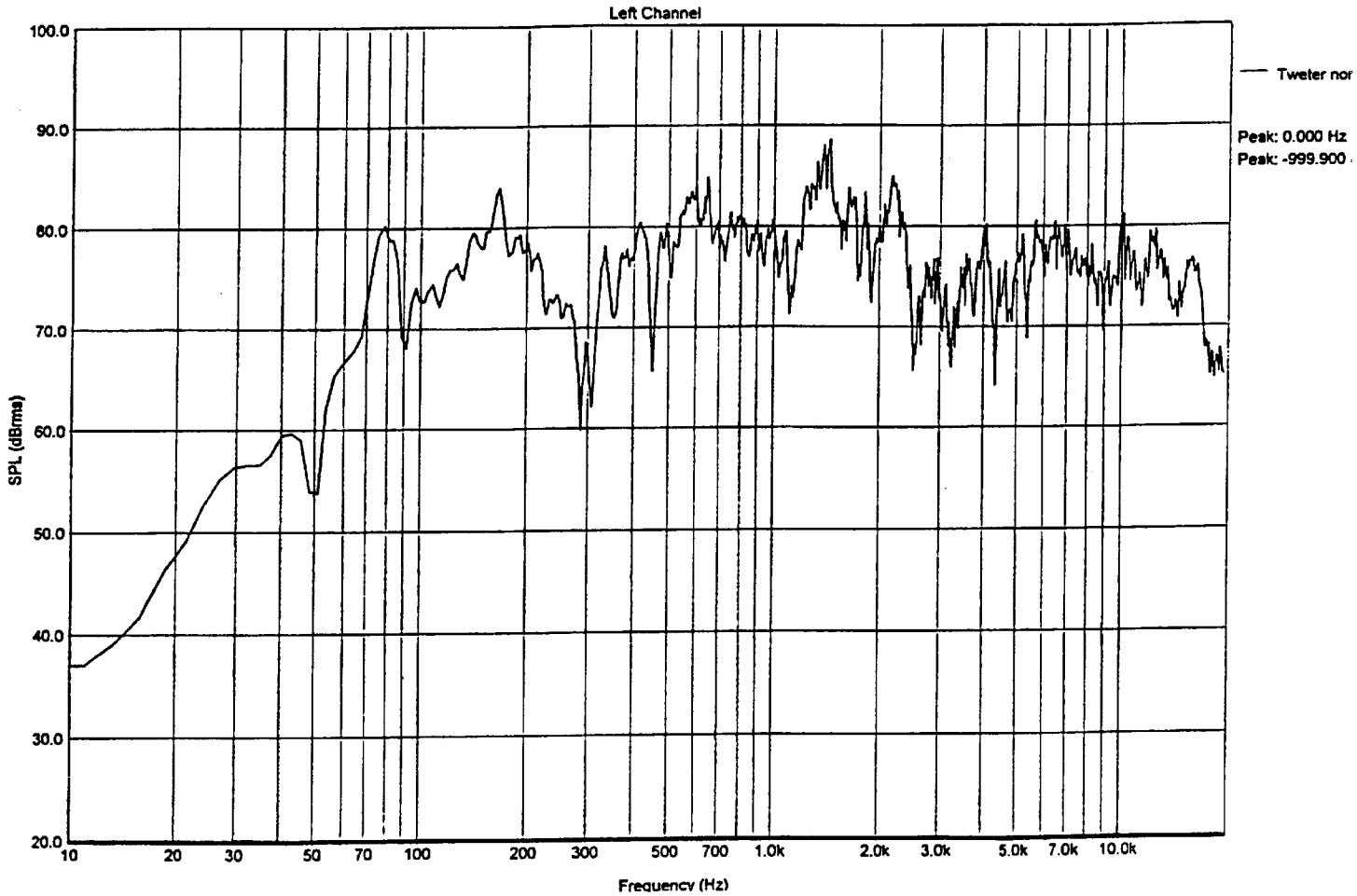
FIG. 20 is a graphic representation showing the results of experiments on frequency characteristics of the loudspeaker system in accordance with the second aspect of the present invention.

FIG. 20 is a characteristic diagram of a model B-2 using only the annular rim for the woofer but having the conventional loudspeaker unit in familiar contact with the baffle plate for the tweeter, wherein equivalent characteristics are secured in the low-frequency band with the increased output and flattening in the high-frequency band as compared with the characteristic of a model B-3 described later which is subjected in principle to no impairment of the bass reflex port effects due to the air leakage.

Figure 21:
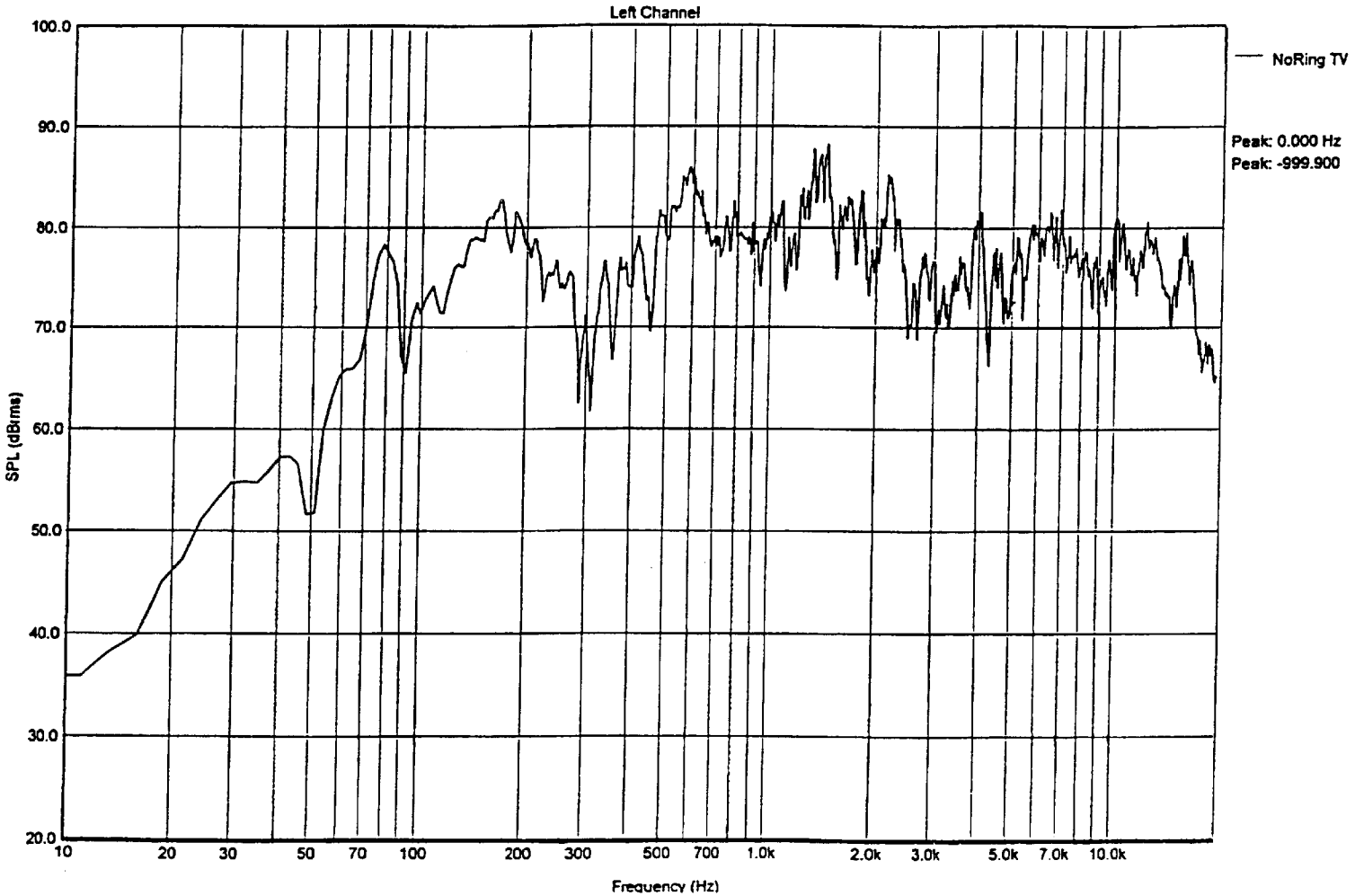
FIG. 21 is a graphic representation showing the results of experiments on frequency characteristics of the loudspeaker system in accordance with the second aspect of the present invention.

FIG. 21 is a characteristic diagram of the model B-3 using only the annular rim for the woofer but having no annular rim for the tweeter, with the loudspeaker unit being fitted via a 0.45 mm thick washer to the baffle plate, and with the gap defined between the loudspeaker unit and the baffle plate being set to a distance allowing tones of cymbals or the like to become clearest as a result of hearing of a music, wherein the low-frequency characteristics are degraded to a large extent (about 3 db at maximum) as compared with the other models B-1 and B-2 due to the air leakage from the periphery of the tweeter. With respect to the high-frequency sound output and flattening as well, it is inferior to the model B-1. The presence of the effect of the annular rim for use in the model B-1 attached to the tweeter will become more apparent also from this model B-3 characteristics.

Figure 22:
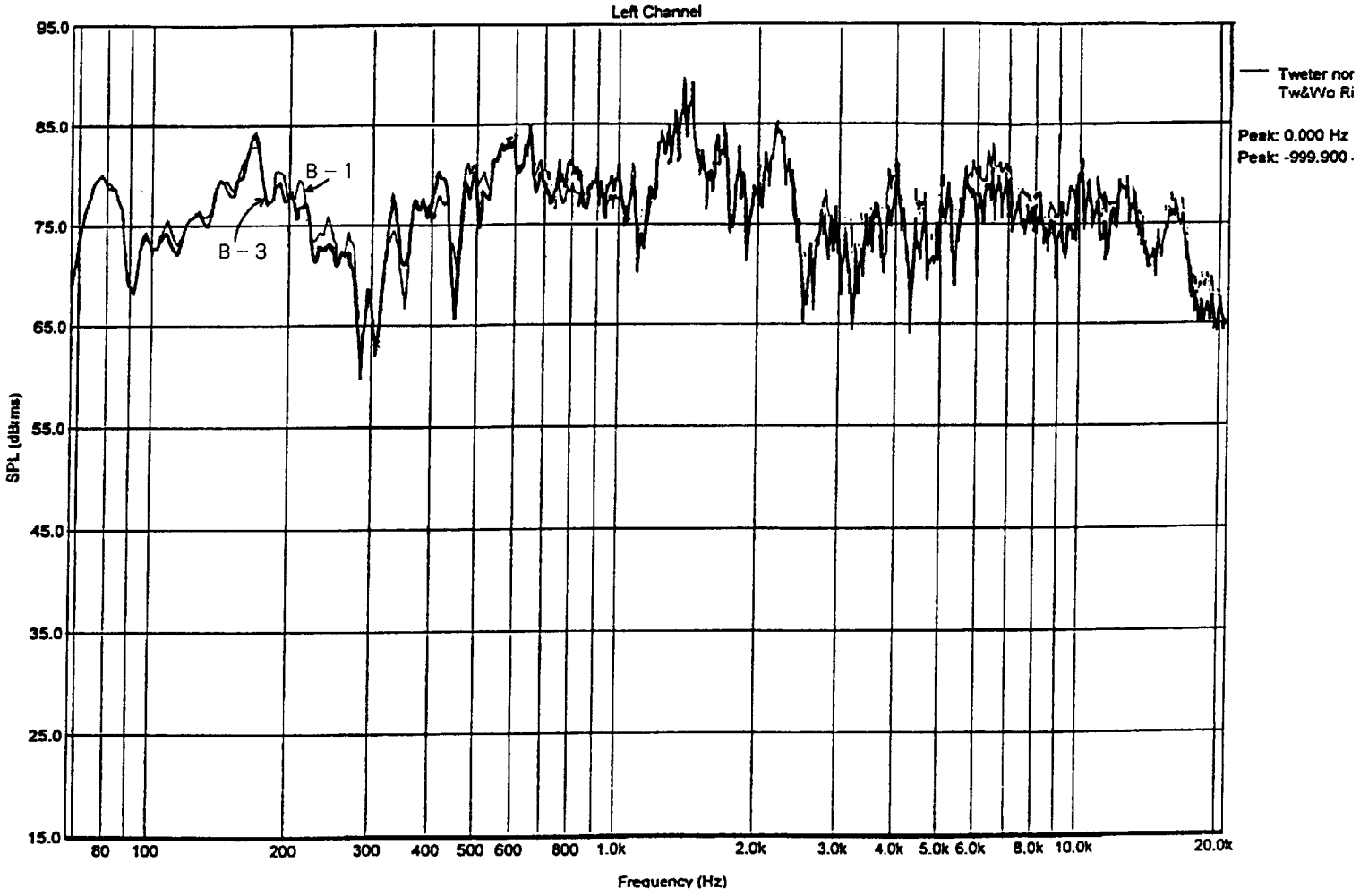
FIG. 22 is a graphic representation showing the results of experiments on frequency characteristics of the loudspeaker system in accordance with the second aspect of the present invention.
Figure 23:
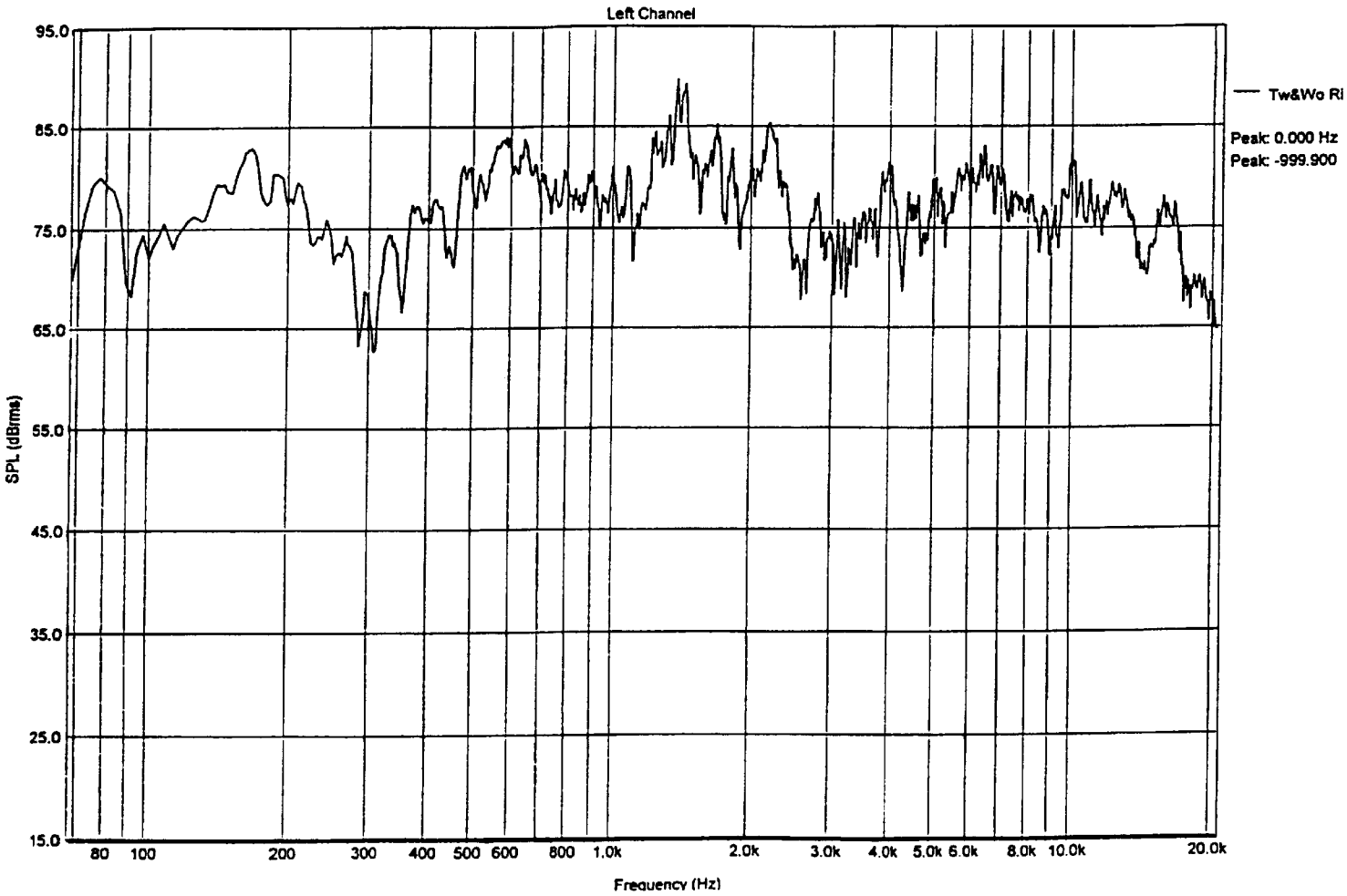
FIG. 23 is a graphic representation showing the results of experiments on frequency characteristics of the loudspeaker system in accordance with the second aspect of the present invention.
Figure 24:
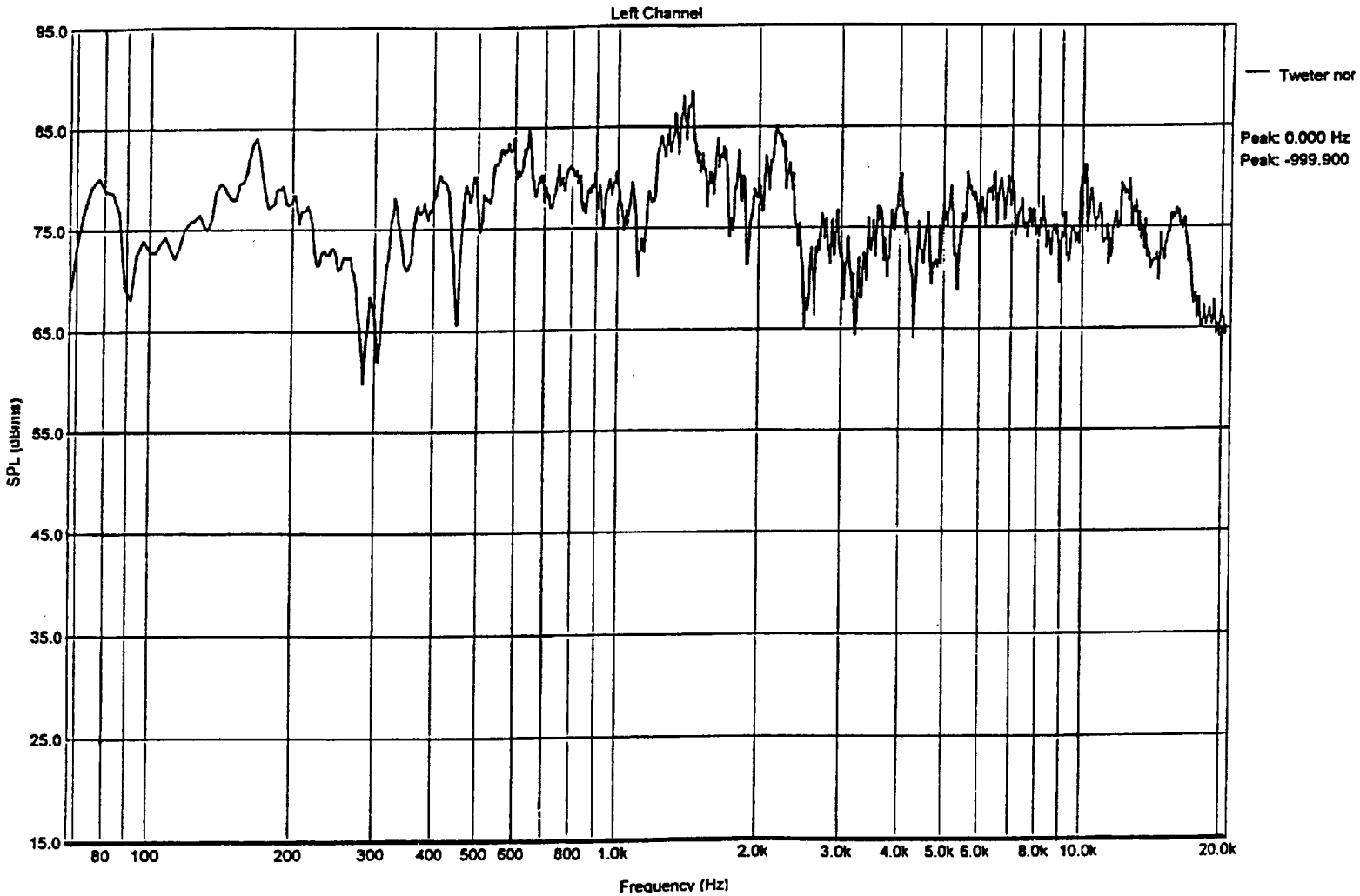
FIG. 24 is a graphic representation showing the results of experiments on frequency characteristics of the loudspeaker system in accordance with the second aspect of the present invention.
Figure 25:
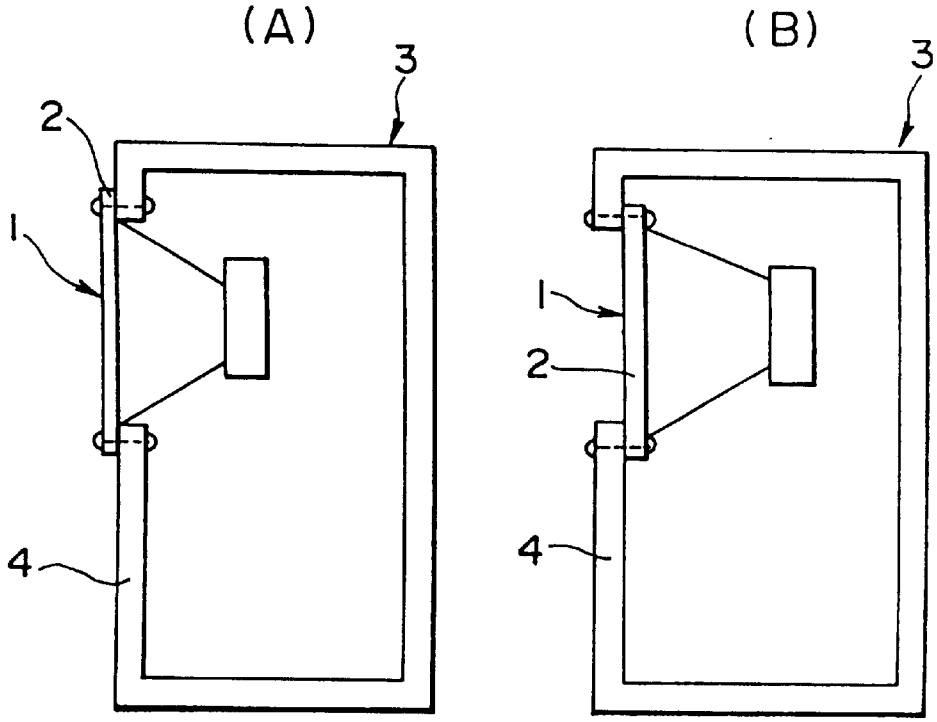
FIG.25 PRIOR ART
FIGS. 25(A) and 25(B) are longitudinal sectional views showing the conventional loudspeaker system by way of example.
Figure 26:
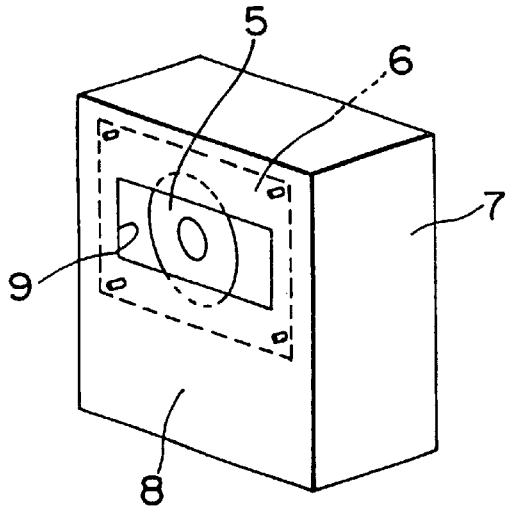
FIG.26 PRIOR ART
FIG. 26 is a perspective view of another example of the conventional loudspeaker system.

It will be appreciated that the characteristic diagram of FIG. 22 shows the high-frequency characteristics of the models B-1 and B-3 in an enlarged scale for improvement in visibility, that the characteristic diagram of FIG. 23 shows the high-frequency characteristics of the model B-1 in an enlarged scale, and that the characteristic diagram of FIG. 24 shows the high-frequency characteristic of the model B-3 in an enlarged scale.

Industrial Applicability

According to the first aspect of the present invention as set forth hereinabove, by virtue of the configuration in which the predetermined air passages are provided at the outer peripheral site of the loudspeaker unit in such a manner as to extend along substantially the overall inner perimeter of the opening in the baffle plate, the air passages serving to allow a communication between the interior and exterior of the enclosure, it is possible to provide a high sound quality loudspeaker system achieving an enhancement of the low-frequency band, a reduction of distortions and a high efficiency while simultaneously reducing the size and weight of the enclosure, as well as having improved transient characteristics and economic considerations.

According to the second aspect of the present invention, by virtue of the simple configuration in which formation is made at the outer peripheral site of the loudspeaker unit in such a manner as to extend along substantially the overall inner perimeter of the opening in the baffle plate, it is possible to provide a high sound quality loudspeaker system achieving an enhancement of the low-frequency band, reduction of distortions and a high efficiency while simultaneously reducing the size and weight of the enclosure, as well as having improved transient characteristics and economic considerations. In particular, the rear face of the outer peripheral portion of the loudspeaker unit is provided with the annular rim for regulating the area confronting both the rear surface of the outer peripheral portion and the front face of the baffle plate whereby the gap is regulated which is defined between the rear face of the outer peripheral portion of the loudspeaker unit and the front face of the baffle plate and which extends along substantially the overall inner perimeter of the opening in the baffle plate, to consequently enable the length of the air passages to be regulated. It is thus possible to suppress any reduction in the additional mass on the loudspeaker unit diaphragm arising from the enclosure interior air and to suppress any damping in the bass reproduction characteristics. Particular effectiveness will therefore be imparted to any small-sized loudspeaker systems liable to suffer any reduction in additional mass on the loudspeaker unit diaphragm and apt to undergo any damping in the bass reproduction characteristics.

What is claimed is:

1. A loudspeaker system including an enclosure and a loudspeaker unit adapted to be fitted to an opening in a baffle plate at the front of said enclosure, wherein said loudspeaker unit is mounted on and fixed to said baffle plate via a plurality of spacers, which transmit vibrations from said loudspeaker unit to said baffle plate, in such a manner that small gaps are formed as predetermined air passages between the rear face of the outer peripheral portion of said loudspeaker unit and the front face of said baffle plate or between the front face of the outer peripheral portion of said loudspeaker unit and the rear face of said baffle plate, said predetermined air passages extending along substantially the overall inner perimeter of said opening in said baffle plate, for allowing a communication between the interior and exterior of said enclosure.

2. A loudspeaker system according to claim 1, wherein said plurality of spacers are formed integrally with said loudspeaker unit or with said baffle plate.

3. A loudspeaker system according to claim 1, wherein said enclosure has a bass reflex port or a bass radiation hole for bass reflex.

4. A loudspeaker system including an enclosure and a loudspeaker unit adapted to be fitted to an opening in a baffle plate at the front of said enclosure, wherein said loudspeaker unit is mounted on said baffle plate in such a manner that between the rear face of the outer peripheral portion of said loudspeaker unit and the front face of said baffle plate there are formed small gaps acting as predetermined air passages which extend along substantially the overall inner perimeter of said opening in said baffle plate and which allow a communication between the interior and exterior of said enclosure, and wherein said loudspeaker unit has, on the rear face of its outer peripheral portion, an annular rim having a larger diameter than the outer peripheral portion for forming said small gaps between said rim and the front face of said baffle plate and for increasing confronting areas of the rear face of said outer peripheral portion and of the front face of said baffle plate for adjusting a length of said air passages.

5. A loudspeaker system including an enclosure and a loudspeaker unit adapted to be fitted to an opening in a baffle plate at the front of said enclosure, wherein said loudspeaker unit is mounted on said baffle plate in such a manner that between the front face of the outer peripheral portion of said loudspeaker unit and the rear face of said baffle plate there are formed small gaps acting as predetermined air passages which extend along substantially the overall inner perimeter of said opening in said baffle plate and which allow a communication between the interior and exterior of said enclosure, and wherein said loudspeaker unit has, on the front face of its outer peripheral portion, an annular rim having a larger diameter than the outer peripheral portion for forming said small gaps between said rim and the rear face of said baffle plate and for increasing confronting areas of the front face of said outer peripheral portion and of the rear face of said baffle plate for adjusting a length of said air passages.

* * * * *